US010539401B2

(12) United States Patent
Jezek et al.

(10) Patent No.: US 10,539,401 B2
(45) Date of Patent: Jan. 21, 2020

(54) DYNAMIC HANGING TARGET

(71) Applicant: Chute Targets, LLC, Austin, TX (US)

(72) Inventors: Maribeth Jezek, Austin, TX (US); Kyle Lane Albrecht, Austin, TX (US)

(73) Assignee: Chute Targets, LLC, Austin, TX (US)

( * ) Notice: Subject to any disclaimer, the term of this patent is extended or adjusted under 35 U.S.C. 154(b) by 0 days.

(21) Appl. No.: 15/925,053

(22) Filed: Mar. 19, 2018

(65) Prior Publication Data

US 2019/0285390 A1 Sep. 19, 2019

(51) Int. Cl.

| | |
|---|---|
| ***F41J 1/10*** | (2006.01) |
| ***F41J 5/26*** | (2006.01) |
| ***F41J 3/00*** | (2006.01) |
| *F41J 7/04* | (2006.01) |

(52) U.S. Cl.

CPC ..... *F41J 5/26* (2013.01); *F41J 3/0004* (2013.01); *F41J 3/0009* (2013.01); *F41J 1/10* (2013.01); *F41J 7/04* (2013.01)

(58) Field of Classification Search

CPC ..... F41J 7/04; F41J 1/10

USPC ..... 273/378, 379, 380, 388, 407; 119/531; 40/617

See application file for complete search history.

(56) References Cited

U.S. PATENT DOCUMENTS

| | | | | |
|---|---|---|---|---|
| 1,337,932 | A | 4/1920 | McClellan et al. | |
| 1,630,717 | A | 11/1925 | Pisano | |
| 1,749,497 | A * | 3/1930 | McGlashan | A01K 39/014 119/531 |
| 2,270,884 | A | 11/1940 | Manson | |
| 2,260,189 | A | 12/1952 | Livermon | |
| 3,685,825 | A | 8/1972 | Dorazio | |
| 4,155,552 | A | 5/1979 | Jacobo et al. | |
| 5,183,427 | A * | 2/1993 | Draper | A63F 9/0073 273/383 |
| 5,222,741 | A * | 6/1993 | Redl | F41J 7/04 273/393 |
| 5,423,142 | A * | 6/1995 | Douglas | G09F 7/002 40/601 |
| 8,844,934 | B2 | 9/2014 | Dean et al. | |
| 8,919,778 | B2 | 12/2014 | Fodera | |
| 9,784,539 | B1 * | 10/2017 | Preuss | F41J 9/16 |
| 2005/0006848 | A1 * | 1/2005 | Fort, II | F41J 1/10 273/407 |
| 2005/0160648 | A1 * | 7/2005 | Voluckas | G09F 7/20 40/617 |
| 2007/0013138 | A1 * | 1/2007 | Hinnant | F41J 1/01 273/407 |
| 2013/0147117 | A1 * | 6/2013 | Graham | F41J 7/04 273/393 |

(Continued)

FOREIGN PATENT DOCUMENTS

| | | |
|---|---|---|
| CN | 2669128 Y | 1/2005 |

*Primary Examiner* — Mark S Graham

(74) *Attorney, Agent, or Firm* — Baker Botts L.L.P.

(57) ABSTRACT

A disclosed hanging target may include a hanging bracket and a plurality of suspension lines coupled to the hanging bracket. The hanging target may also include a plurality of target holders. A destructible target may be disposed above and carried by a target holder allowing a portion of each suspension line to extend outward around the destructible target. When the destructible target is destroyed by a projectile that hits the destructible target, the portion of each suspension line may rebound to the generally vertical orientation.

19 Claims, 17 Drawing Sheets

(56) References Cited

U.S. PATENT DOCUMENTS

| | | | | |
|---|---|---|---|---|
| 2014/0042700 | A1 | 2/2014 | Baron | |
| 2015/0362296 | A1 | 12/2015 | Medendorp | |
| 2017/0219318 | A1* | 8/2017 | Nicholson | F41J 1/01 |
| 2018/0051965 | A1* | 2/2018 | Foley | F41J 7/04 |

* cited by examiner

FIG. 7B
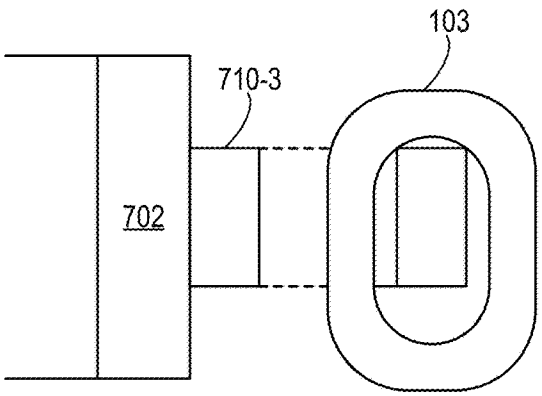
FIG. 7A
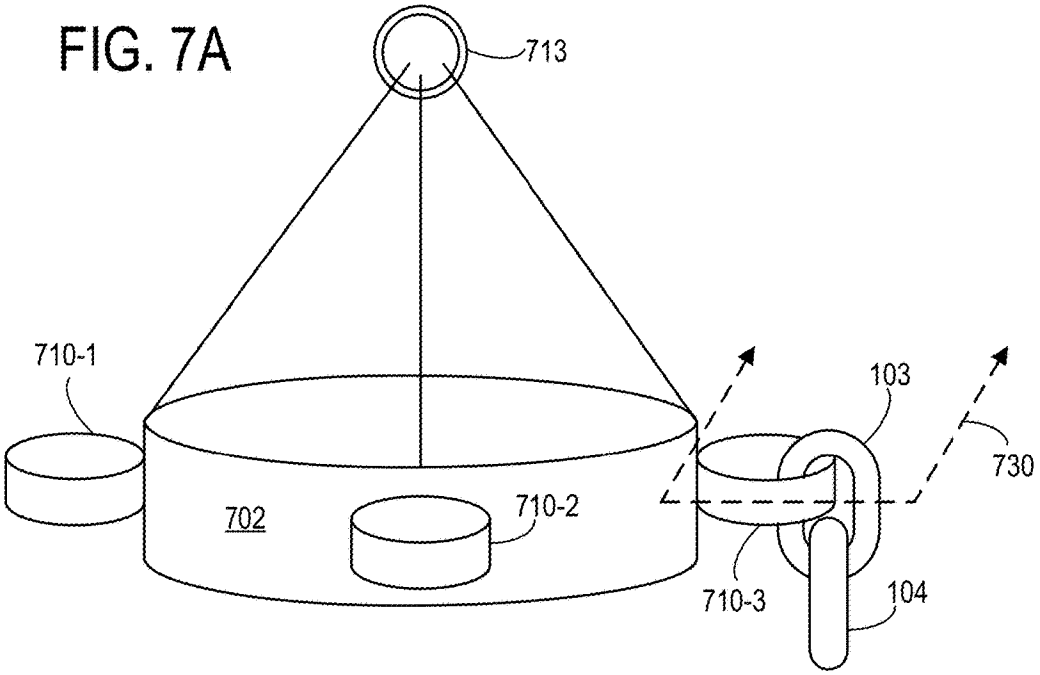
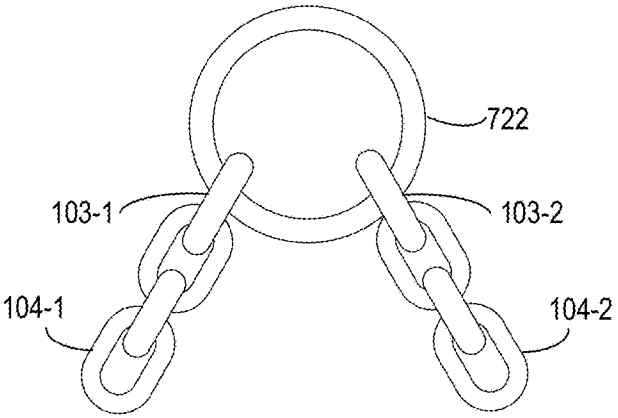
FIG. 7C

DYNAMIC HANGING TARGET

BACKGROUND

Field of the Disclosure

This disclosure relates generally to targets and, more particularly, to a dynamic hanging target.

Description of the Related Art

In order to obtain practice in firing a weapon and to become proficient in shooting, it is typical for a shooter to fire weapons at targets positioned remotely from the shooter's firing position. In many cases, such targets are fixed. Fixed targets typically comprise a round target area or a figure profile, and are often comprised of paper attached to a standard target frame, either directly or via a cardboard backing. However, in the case of a fixed profile paper target, it is often difficult to determine where on the target a shot hit, and, with very distant targets, it is often even difficult to determine whether the shot hit the target at all.

SUMMARY

In one embodiment, a disclosed dynamic hanging target may include a hanging bracket and a plurality of suspension lines coupled to the hanging bracket. The plurality of suspension lines may be generally parallel with each other in a generally vertical orientation. The hanging target may also include a plurality of target holders including a first target holder and a second target holder. Each target holder may be coupled in either a fixed or slidable manner to the plurality of suspension lines such that the first target holder may be positioned at a first position of the plurality of suspensions lines and the second target holder may be positioned at a second position of the plurality of suspensions lines lower than the first position. In one embodiment, a destructible target may be disposed above and carried by the second target holder allowing a portion of each suspension line to extend outward around the destructible target. When the destructible target is destroyed by a projectile that hits the destructible target, the portion of each suspension line may rebound to the generally vertical orientation.

In a number of the disclosed embodiments of the hanging target, when the destructible target is destroyed, the first target holder may slide downward to abut the second target holder.

In a number of the disclosed embodiments of the hanging target, each target holder may further include a plurality of cylindrical rings coupled to an outer side of the target holder and each suspension line may pass through a respective cylindrical ring of each target holder.

In a number of the disclosed embodiments of the hanging target, each cylindrical ring of the plurality of cylindrical rings may have a rounded, chamfered, or beveled bottom edge to reduce disruptions or binding while a respective target holder slides downward along the plurality of suspension lines.

In a number of the disclosed embodiments of the hanging target, each suspension line may pass through a portion of each target holder.

In a number of the disclosed embodiments of the hanging target, each target holder may further include a plurality of cylindrical holes in an inner portion of the target holder and each suspension line may pass through a respective cylindrical hole of each target holder.

In a number of the disclosed embodiments of the hanging target, each target holder may further include a plurality of cylindrical rings coupled to an outer side of the target holder and a plurality of flanges. Each flange of the plurality of flanges may be coupled to two respective cylindrical rings of the plurality of cylindrical rings, and each suspension line may pass through a respective cylindrical ring of each target holder.

In a number of the disclosed embodiments of the hanging target, each target holder may be coupled in a fixed manner to the plurality of suspension lines at a respective fixed position of each suspension line.

In a number of the disclosed embodiments of the hanging target, each target holder may have a rounded, chamfered, or beveled top edge to prevent the destructible target from being destroyed when the destructible target contacts a respective target holder.

In a number of the disclosed embodiments of the hanging target, each target holder may comprise material that may be selected to reduce or prevent ricochets, which may include a polymer sheet, a formed polymer, a polymorphic polymer, rubber, plastic, wood, a cross-sectional portion of a tree trunk, metal, steel, stainless steel, steel alloy, iron, or combinations thereof.

In a number of the disclosed embodiments of the hanging target, each target holder may have an external surface that may comprise a portion of an image and when abutted or juxtaposed the external interfaces of the plurality of the target holders may comprise and display the complete image.

In a number of the disclosed embodiments of the hanging target, each target holder may include a cross-sectional portion of a sculpture and when juxtaposed the plurality of the target holders may comprise the complete sculpture.

In a number of the disclosed embodiments of the hanging target, each suspension line may comprise a chain, a cable, a coated cable, a rope, a plastic line, a string, a polymeric strand or strip, other coated or sheathed material, or a ribbon.

In a number of the disclosed embodiments of the hanging target, the projectile may comprise a metallic ball, a pellet, a bullet, an arrow, slingshot ammunition, nerf balls, paint balls, air soft pellets, or a dart.

In a number of the disclosed embodiments of the hanging target, the destructible target may comprise an inflatable device, a water-filled device, a piece of suitably sized and shaped fruit, a balloon or other filled bladder, a sponge, or a bladder filled with chalk or other powder, or a self-healing device.

In a number of the disclosed embodiments of the hanging target, the hanging target may also include a suspended target coupled to the second target holder below the second target holder. The suspended target may be operable to swivel such that the suspended target may spin when hit by a projectile.

In a number of the disclosed embodiments of the hanging target, the hanging target may also include a suspended target coupled to at least one of the plurality of suspensions lines below the second target holder.

In a number of the disclosed embodiments of the hanging target, the destructible target may include a bladder filled with chalk or suitable powder.

In a second embodiment, a method may include moving a first target holder of a plurality of target holders of a hanging target positioned at a first position of a plurality of suspension lines of the hanging target to a second position of the plurality of suspensions lines higher than the first position. The plurality of suspensions lines may be coupled to each target holder and a hanging bracket of the hanging target, and the plurality of suspensions lines may be generally parallel with each other in a generally vertical orientation. The method may also include disposing a destructible target at a second target holder of the plurality of target holders between the plurality of suspension lines such that a respective portion of each suspension line of the plurality of suspension lines may extend outward around the destructible target and such that when the destructible target is destroyed by a projectile that hits the destructible target, the respective portion of each suspension line may rebound to the generally vertical orientation. The second target holder may be positioned at a third position of the plurality of suspensions lines lower than the first position and below the first target holder.

In a third embodiment, a disclosed dynamic hanging target may include a hanging bracket and a plurality of suspension lines coupled to the hanging bracket. The plurality of suspension lines may be generally parallel with each other in a generally vertical orientation. The dynamic hanging target may also include a plurality of target holders including a first target holder and a second target holder. Each target holder may be coupled to the plurality of suspension lines such that the first target holder is positioned at a first position of the plurality of suspensions lines above the second target holder and the second target holder is positioned at a second position of the plurality of suspensions lines. The first target holder may be operable to slide downward along the plurality of suspension lines in a generally vertical direction. The second target holder may be operable to receive destructible targets such that when a first destructible target disposed above and carried by the second target holder is destroyed by a projectile that hits the first destructible target, the first target holder may slide downward to abut the second target holder.

BRIEF DESCRIPTION OF THE DRAWINGS

For a more complete understanding of the present invention and its features and advantages, reference is now made to the following description, taken in conjunction with the accompanying drawings, in which:

FIGS. 7A, 7B, and 7C are various views including selected elements of embodiments of hanging brackets;

DESCRIPTION OF PARTICULAR EMBODIMENTS

Figure 1A:
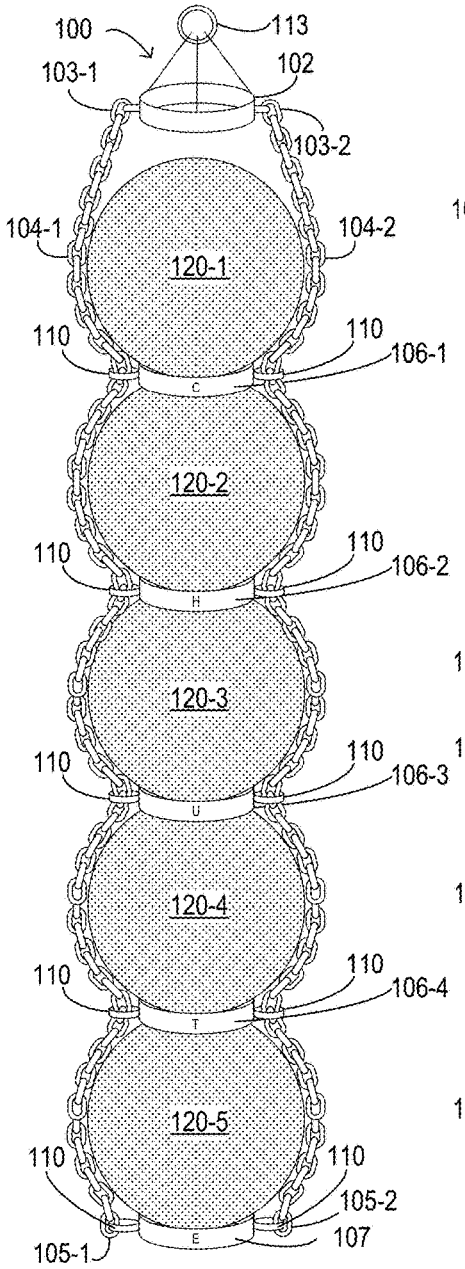
FIGS. 1A, 1B, and 1C are three-dimensional front views including selected elements of embodiments of hanging targets with movable target holders in various positions.

In the following description, details are set forth by way of example to facilitate discussion of the disclosed subject matter. It should be apparent to a person of ordinary skill in the field, however, that the disclosed embodiments and all the details and descriptions associated therewith are exemplary and not exhaustive of all possible embodiments and are not meant to limit the scope of the invention which scope is solely defined by the appended claims.

As used herein, a hyphenated form of a reference numeral refers to a specific instance of an element and the unhyphenated form of the reference numeral refers to the collective or generic element. Thus, for example, widget "72-1" refers to an instance of a widget class, which may be referred to collectively as widgets "72" and any one of which may be referred to generically as a widget "72".

Particular embodiments are best understood by reference to FIGS. 1A-1C, 2, 3A-3C, 4A and 4C, 5A-5D, 6A-6D, 7A-7C, 8A and 8B, 9A and 9B, 10A and 10B, 11A and 11B, 12A and 12B, 13A-13C, 14, 15, 16A, and 16B wherein like numbers are used to indicate like and corresponding parts.

Figure 1B:
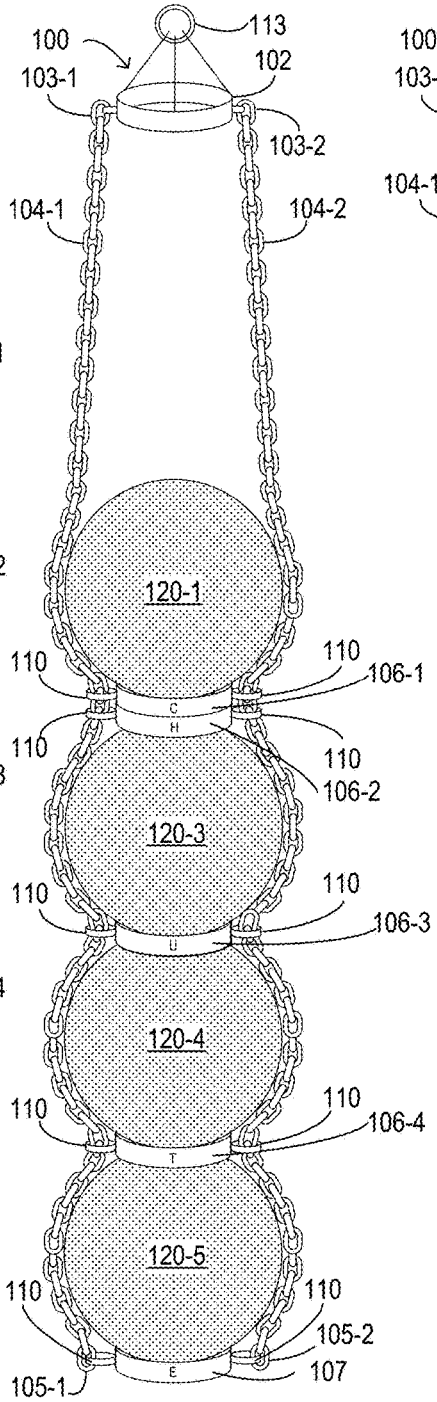
Figure 1C:
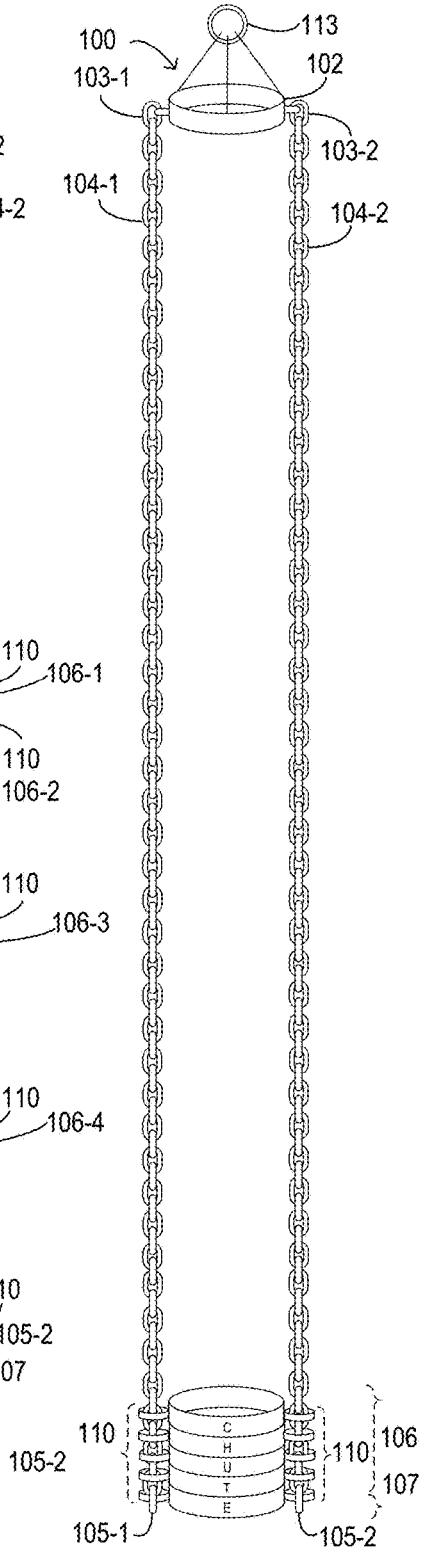

Referring now to the drawings, FIGS. 1A, 1B, and 1C illustrate three-dimensional front views including selected elements of an embodiment of a dynamic hanging target 100 with movable target holders in various states or positions. The various positions may include a fully-loaded position, a partially-loaded position, and an empty position. Hanging target 100 may include a hanging bracket 102, a plurality of suspension lines 104 including suspension lines 104-1 and 104-2, and a plurality of target holders 106 including target holders 106-1, 106-2, 106-3, 106-4, and a bottom target holder 107. Although hanging target 100 is shown including two suspension lines 104 and five target holders 106, hanging target 100 may include two or more suspension lines 104 and two or more target holders 106. A height of hanging target 100 from bottom target holder 107 to hanging bracket 102 may be any suitable height, which may vary based on the number of target holders 106 and the positions of the target holders 106. For example, the height of hanging target 100 as shown in FIG. 1A may be between 2' to 4.5', or another suitable height, when hanging target 100 is in the fully loaded position. The number and position of each suspension line 104 may be selected to provide an appropriate amount of strength to support all of the components of hanging target 100, provide proper balance for each of the target holders 106, and reduce or prevent damage to the suspension lines 104 by positioning each suspension line 104 outside a target area. Hanging bracket 102 may include various types of material including a polymer sheet, plastic, wood, a cross-sectional portion of a tree trunk, metal, steel, stainless steel, steel alloy, iron, or another type of material. In one particular embodiment, hanging bracket 102 is constructed from three inch schedule 40 carbon steel for durability. In another embodiment, a suitable self-healing polymer or self-healing polymer coating is used to reduce the weight of the material. Such a self-healing polymer is described in U.S. patent application publication No. 2014/0042700. Self-healing polymers also allow for a projectile such as a bullet to pass through the material thus preventing ricochets in dangerous directions. The material of hanging bracket 102 may be selected from such a polymer or other soft or permeable materials to reduce or prevent such ricochets. One particular exemplary embodiment of hanging bracket 102 is described in further detail below with reference to FIGS. 7A and 7B.

In one exemplary embodiment, suspension line 104 is depicted as a chain, which may include various types of material including metal, steel, stainless steel, steel alloy, iron, another type of chain material, or combinations thereof. In one particular embodiment, suspension line 104 comprises a carbide steel graded chain of between grade 60 and grade 120 with a particular embodiment using a 3/16 inch to 5/16 inch grade 80 chain. In addition, in particular embodiments, such a chain can be coated in a plastic, polymorphic polymer coating, rubber, paint or other suitable material to enhance the ability of the chain to slide through channels or openings of other components. Such a coating can also be used to introduce coloring to the particular embodiment of the suspension line 104. The material of a suspension line 104 may be selected to reduce or prevent ricochets. In one or more other embodiments, suspension line 104 may also comprise a cable, a coated cable, a rope, a plastic line, a string, a ribbon, polymeric strand or strip, or another type of suspension line. A rope may include one or more types of material including nylon, natural fibers, wire, synthetic fibers, stainless steel wire, carbon steel wire, another type of rope material, or combinations thereof As shown in FIG. 1A, hanging bracket 102 is coupled to and suspended from ring 113 and each suspension line 104 is coupled to hanging bracket 102 by an end portion 103 of a respective suspension line 104 via a respective cylindrical ring of hanging bracket 102, which may comprise a right circular hollow cylinder. For example, the respective cylindrical ring may pass through the end portion 103. In other embodiments, the end portion 103 may be attached to the outer body of hanging bracket 102 by an attachment process, such as, for example, a welding process, an adhesive process, using bolts, screws, rivets or another type of attachment process. In one or more other embodiments, a suspension line 104 may be attached to a cylindrical ring of hanging bracket 102 at the end portion 103, attached to the outer body of hanging bracket 102, or another type of attachment mechanism. As depicted in FIG. 1A, suspension line 104-1 includes end portion 103-1 and suspension line 104-2 includes end portion 103-2. As will be apparent herein, the term 'coupled' is intended to be interpreted broadly to include both fixed couplings and couplings that allow for relative movement between the coupled elements. In other embodiments, the suspension lines 104 may be removably coupled to the hanging brackets 102 using suitable removable fasteners such as snap clasps, carabiners, bolt and nut combinations, hooks or snap hooks so that the hanging target 100 can be disassembled for packaging, storage or to access its components to repair or replace broken elements.

In general, various embodiments of the dynamic hanging target of the present invention provide for a target that creates a dynamic experience for a user. For example, when a portion of the target is struck by an arrow, bullet or other projectile, the target will react in a dynamic and entertaining manner. In certain embodiments, the target could comprise an inflated balloon and when the balloon is struck and burst, a portion of the target resting on the balloon prior to its destruction by bursting would move. In this manner, the user, from a great distance would know that her shot had struck the balloon by the bursting of the balloon and the subsequent movement of the portion of the target. Depending on the embodiment chosen, the bursting of the target could also include the sudden dispersion of liquid or powder contained within the target to indicate that the target has been struck. As will be seen, various embodiments incorporate a variety of other configurations and examples of such dynamism.

In FIG. 1A, a target holder 106 may include various types of material including a polymer sheet, a formed or molded polymer, a polymorphic polymer, rubber, plastic, wood, a cross-sectional portion of a tree trunk, metal, steel, stainless steel, steel alloy, iron, or another type of material. In one particular embodiment, target holder 106 is constructed from three inch schedule 40 carbon steel for durability. In another embodiment, a suitable self-healing polymer or self-healing polymer coating is used to reduce the weight of the material. Self-healing polymers also allow for a projectile such as a bullet to pass through the material thus preventing ricochets in dangerous directions. The material of target holder 106 may be selected from such a polymer or other soft or permeable materials to reduce or prevent such ricochets. In particular embodiments, target holder 106 may comprise an additional counter weight to enhance the ability of the target holder to slide downward along suspension lines 104 in a generally vertical direction. In one embodiment, target holder 106 may include a plurality of cylindrical rings 110, one cylindrical ring 110 corresponding to each of the suspension lines 104. Each cylindrical ring 110 may comprise a right circular hollow cylinder. A cylindrical ring 110 may be attached to the outer body of the target holder 106 by an attachment process, such as, for example, a welding process, an adhesive process, using bolts, screws, rivets or another type of attachment process. The suspension lines 104 may be generally parallel with each other in a generally vertical orientation. The target holder 106 may be movably coupled to each suspension line 104 at a first position of each suspension line 104. Another target holder 106 may be movably coupled to each suspension line 104 at a second position of each suspension line 104, which may be a lower position than the first position. For example, as shown, target holder 106-1 is positioned lower than target holder 106-2, target holder 106-3 is positioned lower than target holder 106-2, target holder 106-4 is positioned lower than target holder 106-3, and bottom target holder 107 is positioned lower than target holder 106-4.

Each suspension line 104 may pass through a respective cylindrical ring 110 of each target holder 106, which may allow each target holder 106 to slide upward and downward along suspension lines 104 in a generally vertical direction. In one or more embodiments, a bottom target holder 107 of hanging target 100 may maintain a fixed position relative to an end portion 105 of a portion of suspension line 104, which is opposite end portion 103. For example, the bottom target holder 107 may be unable to slide downward and may maintain a fixed position. As shown, according to one embodiment each suspension line 104 is attached to the body of the bottom target holder 107. In one or more embodiments, an end portion 105 of suspension line 104 may be attached to a cylindrical ring 110 of a bottom target holder 107, or another type of attachment mechanism may be utilized to attach the end portion 105 of suspension line 104 to the bottom target holder 107. As depicted in FIG. 1A, suspension line 104-1 includes end portion 105-1 and suspension line 104-2 includes end portion 105-2.

Each target holder 106 and bottom target holder 107 may hold a destructible target 120. A destructible target 120 may comprise an inflatable device such as a balloon or bladder, a liquid-filled device, a piece of suitably sized and shaped fruit, a self-healing device comprising a self-healing polymer or a self-healing polymer coating, or another type of destructible target. Suitable fruit may include a cantaloupe, a watermelon, a melon, a grapefruit, or another type of fruit. An inflatable device may include a balloon, an inflatable ball, or another type of inflatable device. A liquid-filled device may include a balloon, a plastic bottle, or another type of liquid-filled device. Destructible target 120 may also comprise a destructible bladder that is filled with a suitable powder or chalk that could be colored and is dispersed when such bladder is destroyed.

Referring to FIG. 1A, hanging target 100 is shown in a fully-loaded position with a destructible target 120 disposed above and carried by each target holder 106 and bottom target holder 107 and held laterally in place by respective portions of suspension lines 104. Each target holder 106 is held vertically in place by a respective destructible target 120 disposed underneath it. For example, when a portion of the target is struck by an arrow, bullet or other projectile, the target will react in a dynamic and entertaining manner. In certain embodiments, the target could comprise an inflated balloon and when the balloon is struck and burst, a portion of the target resting on the balloon prior to its destruction by bursting would move. In this manner, the user, from a great distance would know that her shot had struck the balloon by the bursting of the balloon and the subsequent movement of the portion of the target. In one or more embodiments, a top portion and a bottom portion of each target holder 106 may have smooth surfaces, which may reduce or prevent damage to a destructible target 120 when contacted by a target holder 106. For example, burrs, splinters, or other imperfections may have been removed from the top and bottom surfaces of a target holder 106 which might otherwise have caused damage to a destructible target 120 such as causing an inflated balloon to burst when the balloon is punctured by a splinter or burr.

Respective portions of suspension lines 104 may extend outward and around a destructible target 120 disposed at a respective target holder 106 or bottom target holder 107. In FIG. 1A, destructible targets 120-1, 120-2, 120-3, 120-4, and 120-5 are disposed at target holders 106-1, 106-2, 106-3, 106-4, and bottom target holder 107, respectively. Destructible target 120-2 may be disposed at target holder 106-2 by raising target holder 106-1 above target holder 106-2 and placing the destructible target 120-2 above target holder 106-2 between respective portions of suspension lines 104. Destructible targets 120-3, 120-4, and 120-5 may be disposed at target holders 106-3, 106-4, and bottom target holder 107 in a similar manner. For example, destructible target 120-5 may be disposed at bottom target holder 107 by raising target holder 106-4 above bottom target holder 107 and placing the destructible target 120-5 above bottom target holder 107 between respective portions of suspension lines 104. Raising target holder 106-4 causes target holders 106-1, 106-2, and 106-3 above target holder 106-4 to also be raised.

When the destructible target 120-2 is destroyed by a projectile that hits the destructible target 120-2, the target holder 106-1 will no longer be held up by the destructible target 120-2 and may slide downward in the generally vertical direction to abut the target holder 106-2. In one or more embodiments, a destructible target 120 may be hit by multiple projectiles before the destructible target is destroyed. A projectile may comprise a metallic ball, a pellet, a bullet, an arrow, a dart, or another type of projectile. A metallic ball, a pellet or a paintball may be fired at a destructible target 120 by an air gun, an air rifle, a slingshot, or another type of firing device. A bullet may me fired at a destructible target 120 by a hand gun, a rifle, an automatic gun, or another type of gun. An arrow may be fired at a destructible target 120 by a bow, a cross-bow, or another type of bow. A dart may be thrown at a destructible target 120 by a blow gun or by hand.

Referring to FIG. 1B, hanging target 100 is shown in a partially-loaded position after the destructible target 120-2 of FIG. 1A has been destroyed. In FIG. 1B, after destructible target 120-2 has been destroyed, target holder 106-1 slid downward to abut target holder 106-2 such that hanging target 100 is in the partially-loaded position. Destructible target 120-1 also slid downward with target holder 106-1, which caused the respective portions of suspension lines 104 previously around destructible target 120-1 to rebound to the generally vertical orientation.

In FIG. 1C, hanging target 100 is shown in an empty position after all of the destructible targets 120 of FIG. 1A have been destroyed or before loading. In FIG. 1C, after all of the destructible targets 120 have been destroyed, target holders 106-1, 106-2, 106-3, and 106-4 slide downward to abut target holders 106-2, 106-3, 106-4, and bottom target holder 107, respectively, such that hanging target 100 is in the empty position. When hanging target 100 is in the empty position, each suspension line 104 between hanging bracket 102 and bottom target holder 107 rebounds to the generally vertical orientation. As stated previously, the example shown in FIGS. 1A through 1C is shown with only two suspension lines 104 for purpose of clarity in the depiction. Any suitable number of suspension lines 104 could be employed without departing from the spirit and scope of the present invention.

Figure 2:
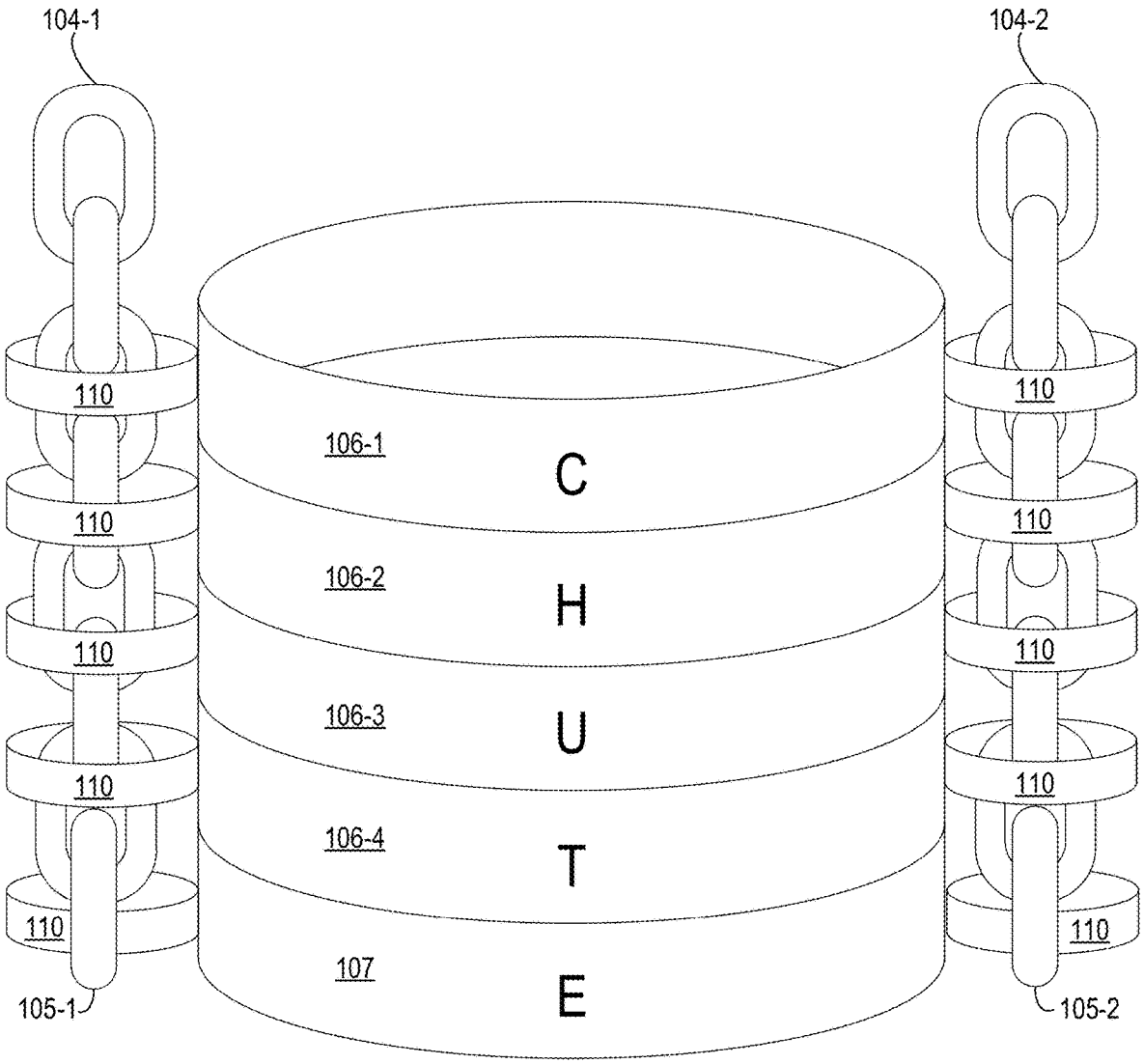
FIG. 2 is a partial three-dimensional front view including selected elements of an embodiment of the hanging target with movable target holders of FIG. 1B in an empty position.

FIG. 2 illustrates a partial three-dimensional front view including selected elements of an embodiment of the hanging target 100 with movable target holders 106 and bottom target holder 107 of FIG. 1B in an empty position. In FIG. 2, target holders 106-1, 106-2, 106-3, 106-4, and bottom target holder 107 are shown in the empty position of hanging target 100 and each suspension line 104 between hanging bracket 102 and bottom target holder 107 are shown in the generally vertical orientation. Each target holder 106 and bottom target holder 107 may have an external surface that may include a portion of an image and when juxtaposed the plurality of the target holders 106 and bottom target holder 107 may include the complete image. As shown, target holder 106-1 includes the letter "C" of a portion of a textual image, target holder 106-2 includes the letter "H", target holder 106-3 includes the letter "U", target holder 106-4 includes the letter "T", and bottom target holder 107 includes the letter "E". Target holders 106 and bottom target holder 107 include the complete textual image "CHUTE" in a generally vertical direction.

Figure 3A:
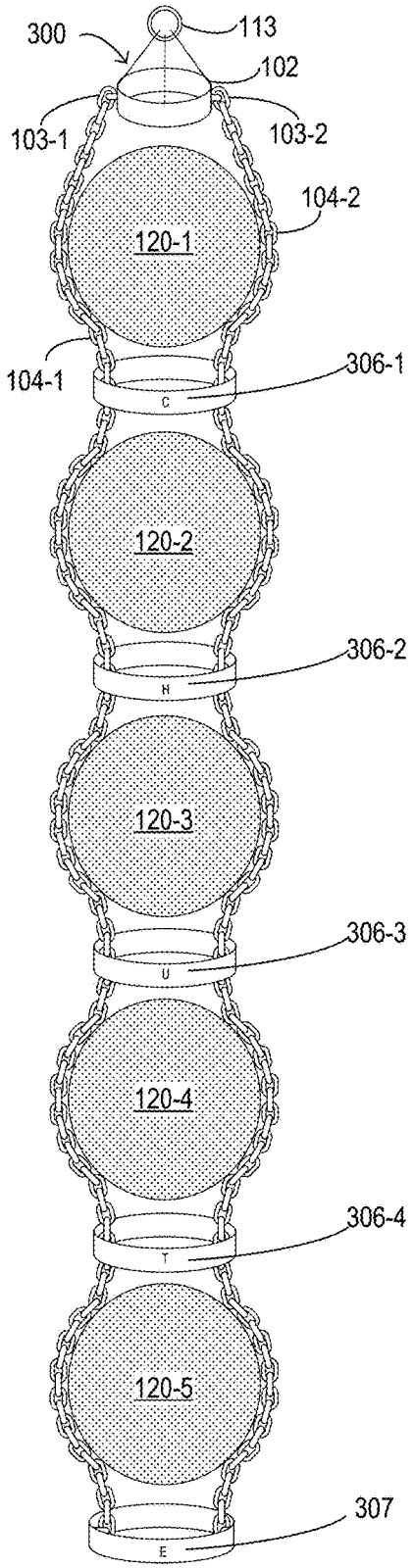
FIGS. 3A, 3B, and 3C are three-dimensional front views including selected elements of embodiments of hanging targets with movable target holders in various positions.
Figure 3B:
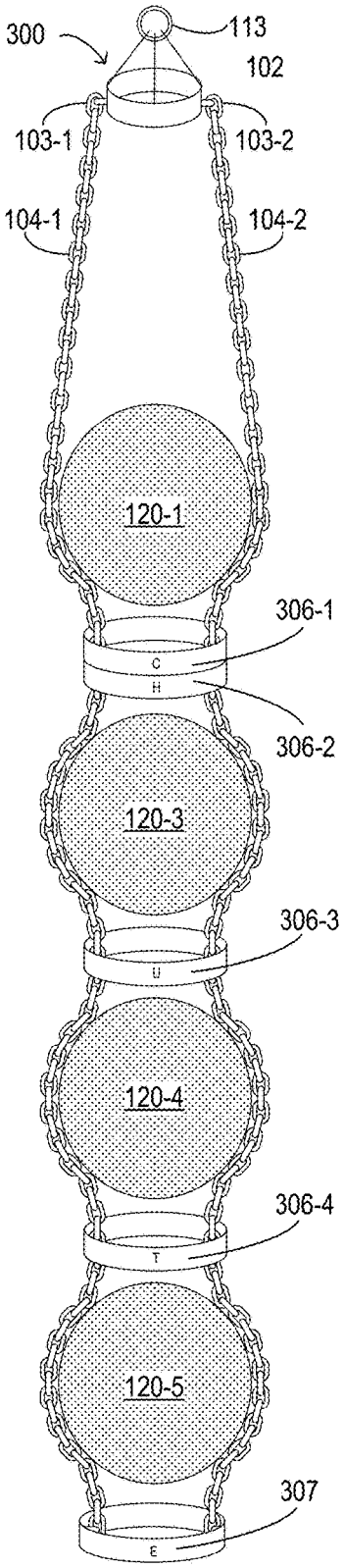
Figure 3C:
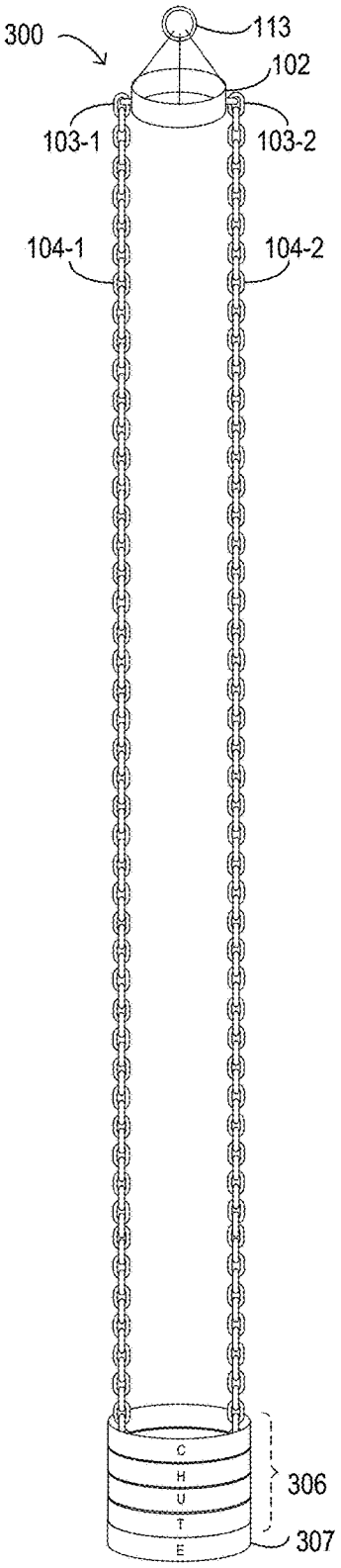

FIGS. 3A, 3B, and 3C illustrate three-dimensional front views including selected elements of an embodiment of a hanging target 300 with movable target holders in various positions. The various position of hanging target 300 may include a fully-loaded position, a partially-loaded position, and an empty position. Hanging target 300 may include one or more components similar to that of hanging target 100 as described above with reference to FIG. 1A. Hanging target 300 may include hanging bracket 102, a plurality of suspension lines 104 including suspension lines 104-1 and 104-2, a plurality of target holders 306 including target holders 306-1, 306-2, 306-3, and 306-4, and a bottom target holder 307. Although hanging target 300 is shown including two suspension lines 104 and five target holders 306, hanging target 300 may include two or more suspension lines 104 and two or more target holders 306. A height of hanging target 300 from bottom target holder 307 to hanging bracket 102 may be any suitable height, which may vary based on the number of target holders 306 and the positions of the target holders 306. For example, the height of hanging target 300 as shown in FIG. 3A may be between 2' to 4.5', or another suitable height, when hanging target 300 is in the fully loaded position. As shown in FIG. 3A, each suspension line 104 is coupled to hanging bracket 102 by an end portion 103 of a respective suspension line 104 via a respective cylindrical ring of hanging bracket 102. The target holder 306 may be movably coupled to each suspension line 104 at a first position of each suspension line 104. Another target holder 306 may be movably coupled to each suspension line 104 at a second position of each suspension line 104, which may be a lower position than the first position. For example, as shown, target holder 306-1 is positioned lower than target holder 306-2, target holder 306-3 is positioned lower than target holder 306-2, target holder 306-4 is positioned lower than target holder 306-3, and bottom target holder 307 is positioned lower than target holder 306-4. Each suspension line 104 may pass through each target holder 306, which may allow each target holder 306 to slide upward and downward along suspension lines 104 in a generally vertical direction. In one or more embodiments, the bottom target holder 307 of hanging target 300 may maintain a fixed position relative to each end portion 105 of a portion of a respective suspension line 104. For example, the bottom target holder 307 may be unable to slide downward and may maintain a fixed position.

Referring to FIG. 3A, hanging target 300 is shown in a fully-loaded position with a destructible target 120 disposed above and carried by each target holder 306 and bottom target holder 307 and held laterally in place by respective portions of suspension lines 104. Respective portions of suspension lines 104 may extend outward and around a destructible target 120 disposed at a respective target holder 306 or bottom target holder 307. In FIG. 3A, destructible targets 120-1, 120-2, 120-3, 120-4, and 120-5 are disposed at target holders 306-1, 306-2, 306-3, 306-4, and bottom target holder 307, respectively. When the destructible target 120-2 is destroyed by a projectile that hits the destructible target 120-2, the target holder 306-1 will no longer be held up by the destructible target 120-2 and may slide downward in the generally vertical direction to abut target holder 306-2.

Referring to FIG. 3B, hanging target 300 is shown in a partially-loaded position after destructible target 120-2 of FIG. 3A has been destroyed. In FIG. 3B, after destructible target 120-2 has been destroyed, target holder 306-1 slid downward to abut target holder 306-2 such that hanging target 300 is in the partially-loaded position. Destructible target 120-1 also slid downward with target holder 306-1, which caused the respective portions of suspension lines 104 previously around destructible target 120-1 to rebound to the generally vertical orientation.

Referring to FIG. 3C, hanging target 300 is shown in an empty position after all of the destructible targets 120 of FIG. 3A have been destroyed or before loading. In FIG. 3C, after all of the destructible targets 120 have been destroyed, target holders 306-1, 306-2, 306-3, and 306-4 slid downward to abut target holders 306-2, 306-3, 306-4, and bottom target holder 307, respectively, such that hanging target 300 is in the empty position. When hanging target 300 is in the empty position, each suspension line 104 between hanging bracket 102 and bottom target holder 307 rebounds to the generally vertical orientation.

Figure 4A:
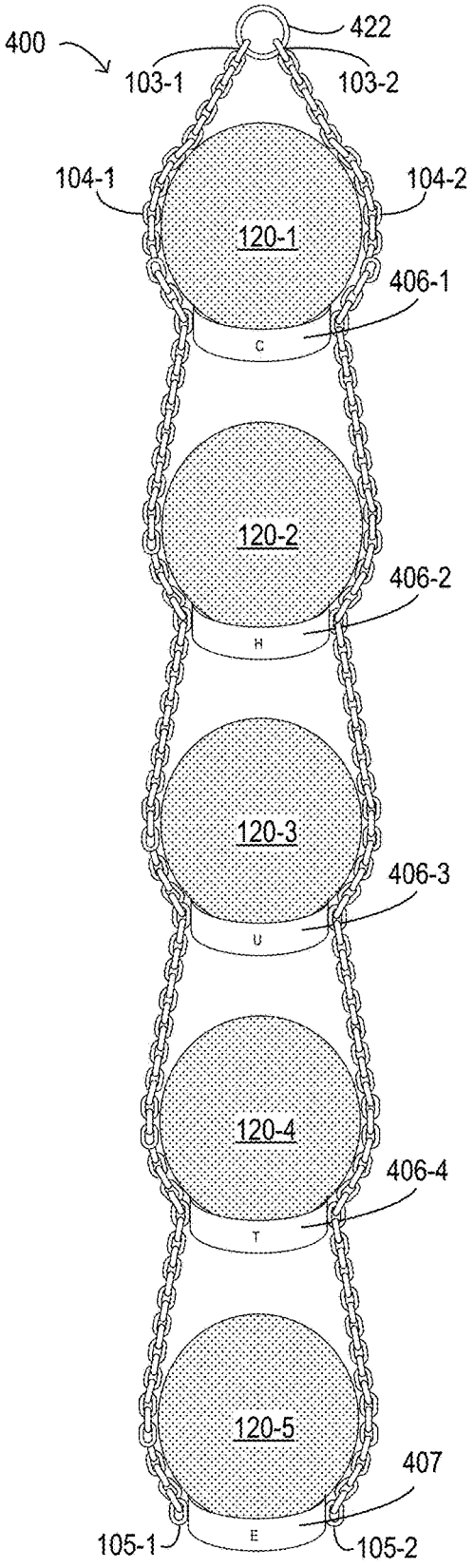
FIGS. 4A and 4B are three-dimensional front views including selected elements of embodiments of hanging targets with fixed target holders in various positions.
Figure 4B:
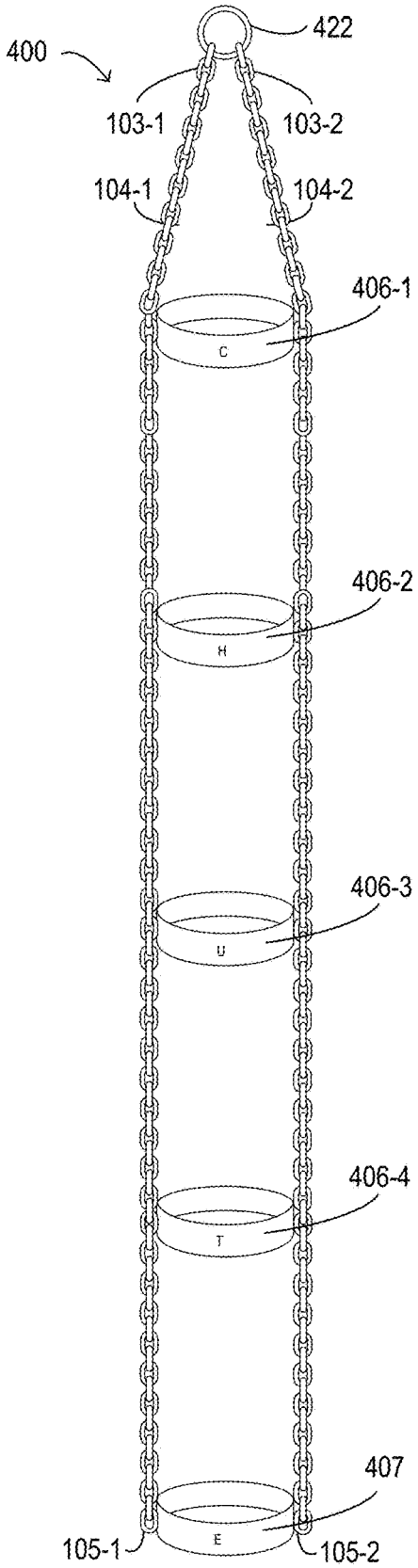

FIGS. 4A and 4B illustrate three-dimensional front views including selected elements of an embodiment of a hanging target 400 with fixed target holders in various positions. In general, in the embodiments illustrated by FIGS. 4A and 4B, the dynamism of the target comprises the destruction of the destructible elements 120 and the return of the suspension lines 104 to a generally vertical orientation but not the movement of the target holders 406. The various position of hanging target 400 may include a fully-loaded position, a partially-loaded position, and an empty position. Hanging target 400 may include one or more components similar to that of hanging target 100 as described above with reference to FIG. 1A. Hanging target 400 may include a hanging bracket 422, a plurality of suspension lines 104 including suspension lines 104-1 and 104-2, a plurality of target holders 406 including target holders 406-1, 406-2, 406-3, and 406-4, and bottom target holder 407. Although hanging target 400 is shown including two suspension lines 104 and five target holders 406, hanging target 400 may include two or more suspension lines 104 and two or more target holders 406. A height of hanging target 400 from bottom target holder 407 to hanging bracket 422 may be any suitable height, which may vary based on the number of target holders 406 and the positions of the target holders 406. For example, the height of hanging target 400 as shown in FIG. 4A may be between 2' to 4.5', or another suitable height, when hanging target 400 is in the fully loaded position.

As shown in FIG. 4A, each suspension line 104 is coupled to hanging bracket 422 by an end portion 103 of a respective suspension line 104. Each target holder 406 and bottom target holder 407 may be attached to each suspension line 104 at a respective fixed position of each suspension line 104 such that each target holder 406 and bottom target holder 407 may be positioned at different fixed positions. For example, as shown, target holder 406-1 is positioned lower than target holder 406-2, target holder 406-3 is positioned lower than target holder 406-2, target holder 406-4 is positioned lower than target holder 406-3, and bottom target holder 407 is positioned lower than target holder 406-4. Each target holder 406 and bottom target holder 407 may be attached to each suspension line 104 by an attachment process, such as, for example, a welding process, an adhesive process, using bolts, screws, rivets or another type of attachment process, which prevents movement of each target holder 406 and bottom target holder 407 relative to the respective fixed position of each suspension line 104.

Referring to FIG. 4A, hanging target 400 is shown in a fully-loaded position with a destructible target 120 disposed above and carried by each target holder 406 and bottom target holder 407 and held laterally in place by respective portions of suspension lines 104. Respective portions of suspension lines 104 may extend outward and around a destructible target 120 disposed at a respective target holder 406 or bottom target holder 407. In FIG. 4A, destructible targets 120-1, 120-2, 120-3, 120-4, and 120-5 are disposed at target holders 406-1, 406-2, 406-3, 406-4, and bottom target holder 407, respectively. When destructible target 120-2 is destroyed by a projectile that hits the destructible target 120-2, respective portions of suspension lines 104 will no longer be extended outward by the destructible target 120-2 and may rebound to the generally vertical orientation.

Referring to FIG. 4B, hanging target 400 is shown in an empty position after all of the destructible targets 120 of FIG. 4A have been destroyed or before loading. In FIG. 4B, after all of the destructible targets 120 have been destroyed, each suspension line 104 between hanging bracket 422 and bottom target holder 407 rebounds to the generally vertical orientation.

In particular embodiments, components of target holders 100, 300, and 400 can be coated in a plastic or other suitable material to introduce coloring to the particular embodiment of the suspension line 104. Such components may include hanging brackets 102 and 422, target holders 106, 306, and 406, cylindrical rings 110, and bottom target holders 107, 307, and 407.

Figure 5A:
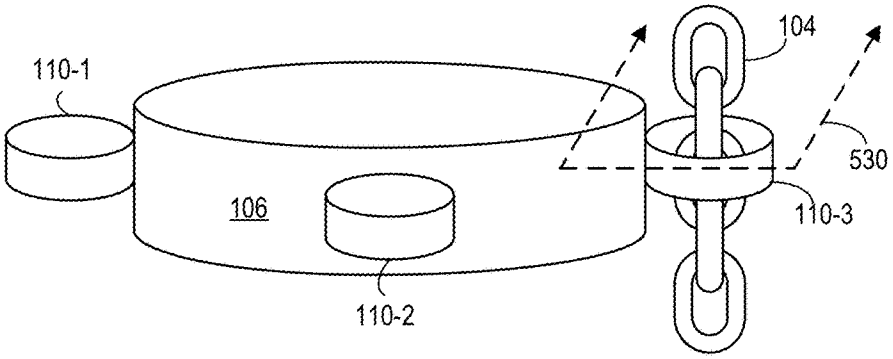
FIGS. 5A, 5B, 5C, and 5D are various views including selected elements of embodiments of a movable target holder.
Figure 5B:
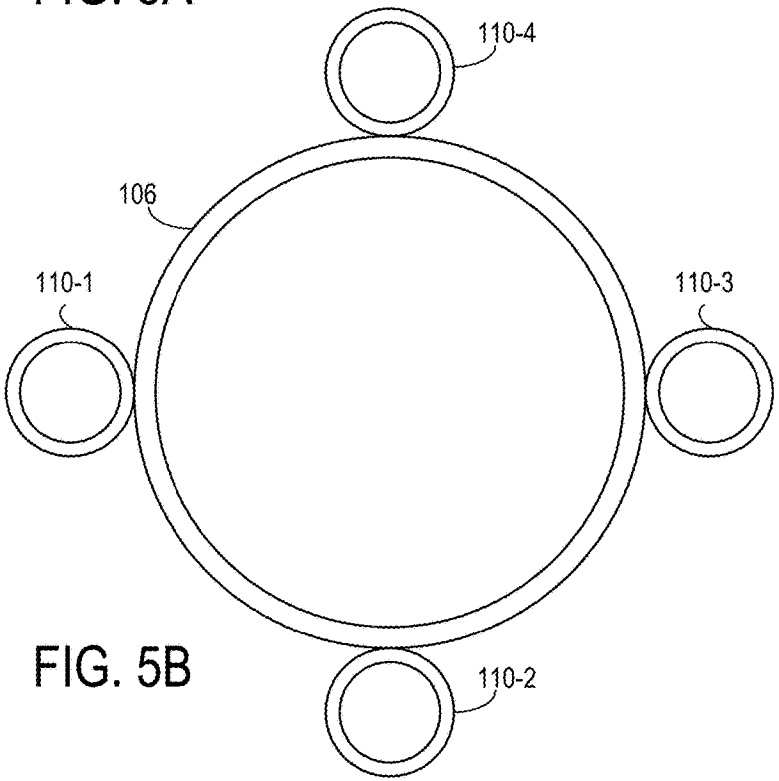

FIGS. 5A, 5B, 5C, and 5D illustrate various views including selected elements of embodiments of movable target holders and cylindrical rings. The various views may include one or more components similar to that of hanging target 100 as described above with reference to FIG. 1A. FIG. 5A shows a three-dimensional front view of a target holder 106 coupled to a plurality of cylindrical rings 110 including cylindrical rings 110-1, 110-2, and 110-3, a portion of a suspension line 104 passing through cylindrical ring 110-3, which is depicted as a chain, and a cut line 530 of a portion of target holder 106 and cylindrical ring 110-3. FIG. 5B shows a top view of target holder 106 coupled to four cylindrical rings 110 including cylindrical rings 110-1, 110-2, 110-3 and 110-4.

Figure 5C:
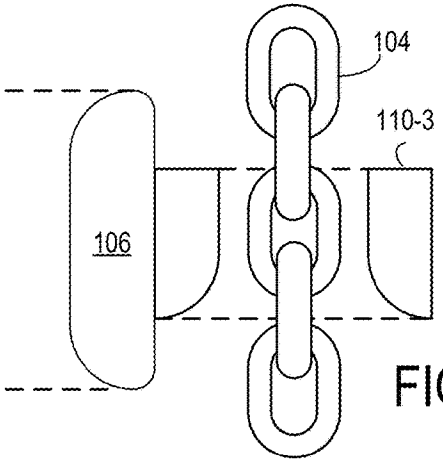

FIG. 5C shows a front view at cut-line 530 of target holder 106, cylindrical ring 110-3, and the portion of suspension line 104 passing through cylindrical ring 110-3. In FIG. 5C, target holder 106 has a rounded, chamfered, or beveled top edge. An inside of the rounded, chamfered, or beveled top edge of target holder 106 may have a larger diameter than the outside of the rounded, chamfered, or beveled top edge. The rounded, chamfered, or beveled top edge of target holder 106 may prevent a destructible target 120 from being destroyed when the destructible target 120 contacts target holder 106, such as, for example, when destructible target 120 is placed on target holder 106. The larger diameter of the inside of the rounded, chamfered, or beveled top edge may allow a destructible target 120 to be better held at target holder 106. In one or more embodiments, target holder 106 may have a rounded, chamfered, or beveled bottom edge, which may prevent a destructible target 120 from being destroyed when the destructible target 120 contacts another target holder 106 above destructible target 120. Surfaces that contact destructible targets 120 may also be coated or painted to prevent burrs or other sharp features of such surfaces from unintentionally prematurely damaging or destroying such destructible targets 120. As shown, cylindrical ring 110-3 has a rounded, chamfered, or beveled bottom edge which may prevent target holder 106 from a possible disruption or binding while target holder 106 slides downward along each suspension line 104. In one or more embodiments, each cylindrical ring 110 attached to a target holder 106 may have a rounded, chamfered, or beveled bottom edge, which may prevent target holder 106 from a possible disruption or binding while target holder 106 slides downward along each suspension line 104 passing through a respective cylindrical ring 110 of target holder 106.

Figure 5D:
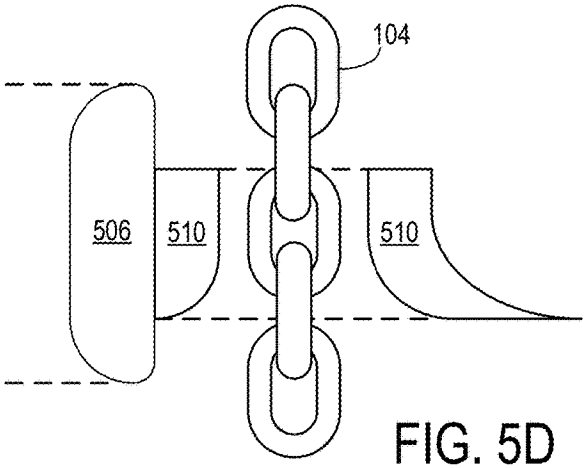

FIG. 5D shows a cut-away front view of a target holder 506 and a cylindrical ring 510. As shown, cylindrical ring 510 has a rounded, chamfered, or beveled bottom edge with a taper proximate an outer side edge of cylindrical ring 510 opposite the body of target holder 506. The taper of cylindrical ring 510 extends outward beyond a top edge of cylindrical ring 510 opposite the bottom edge with the taper. In one or more embodiments, each cylindrical ring 510 attached to a target holder 506 may have a rounded, chamfered, or beveled bottom edge with a taper that extends beyond a top edge of each cylindrical ring 510, which may strengthen each cylindrical ring 510 and may prevent target holder 506 from a possible disruption or binding while target holder 506 slides downward along each suspension line 104 passing through a respective cylindrical ring 510 of target holder 506.

In some embodiments, target holders 106 may have a height between ¾" to 2", an inside diameter between 2.75" and 7.75", an outside diameter between 3" and 8 ⅝", and a thickness of between on the order of 0.133" to 0.375". In one particular embodiment, such target holders may have a height of 1", an inside diameter of 3.068", and an outside diameter of 3.5", and a thickness of between on the order of 0.133" to 0.375". In one or more other embodiments, the height, inside and outside diameters, and thickness of target holders 106 may have different dimensions based on the type of material utilized, dimensions of destructible targets 120, number of target holders, among other factors. In some embodiments, cylindrical rings 110 may have a height between ¾ " to 2", an inside diameter between ¾" and 1.5", an outside diameter between 1" and 2", and a thickness of between on the order of 0.133" to 0.375". In one particular embodiment, such cylindrical rings may have a height of ¼", an inside diameter of 1.049", an outside diameter of 1.35", and a thickness of 0.301". In one or more other embodiments, the height, inside and outside diameters, and thickness of cylindrical rings 110 may have different dimensions based on the type of material utilized, dimensions of target holders 106, dimensions of suspension lines 104, among other factors.

Figure 6A:
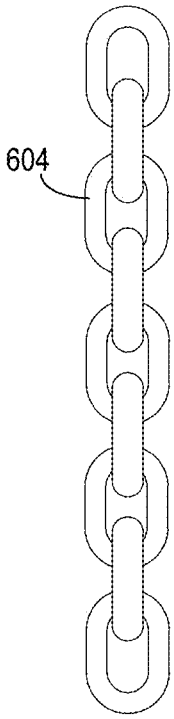
FIGS. 6A, 6B, 6C, and 6D illustrate selected elements of embodiments of a suspension line.
Figure 6B:
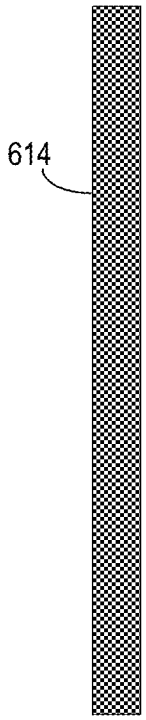
Figure 6C:
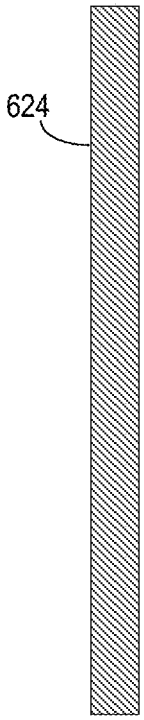
Figure 6D:
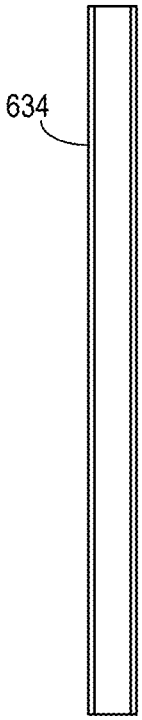

FIGS. 6A, 6B, 6C, and 6D illustrate particular embodiments of a suspension line. In FIG. 6A, suspension line 604 is depicted as a chain. In FIG. 6B, suspension line 614 is shown as a cable. In FIG. 6C, suspension line 624 is depicted as a rope. In FIG. 6D, suspension line 634 is shown as a ribbon.

FIGS. 7A, 7B, and 7C illustrate various views including selected elements of embodiments of hanging brackets. The various views may include one or more components similar to that of hanging target 100 as described above with reference to FIG. 1A.

FIG. 7A shows a three-dimensional front view of a hanging bracket 702 coupled to a plurality of cylindrical rings 710 including cylindrical rings 710-1, 710-2, and 710-3, a portion of a suspension line 104 coupled to cylindrical ring 710-3, which is depicted in exemplary form as a chain, and a cut line 730 of a portion of hanging bracket 702 and cylindrical ring 710-3. As shown, the portion of suspension line 104 is coupled to cylindrical ring 710-3 by cylindrical ring 710-3 passing through an end portion 103 of the portion of suspension line 104. In FIG. 7A, hanging bracket 702 is coupled to ring 713.

FIG. 7B shows a front view at cut-line 730 of hanging bracket 702, cylindrical ring 710-3, and the end portion 103 coupled to cylindrical ring 710-3. As shown, the end portion 103 has a downward generally vertical orientation.

FIG. 7C illustrates a front view of a hanging ring 722. As shown, an end portion 103-1 of a portion of suspension line 104-1 and an end portion 103-2 of a portion of suspension line 104-2 are coupled to the hanging ring 722 in a downward generally angled orientation. Hanging ring 722 may be utilized by hanging targets 100, 300, and 400.

Figure 8A:
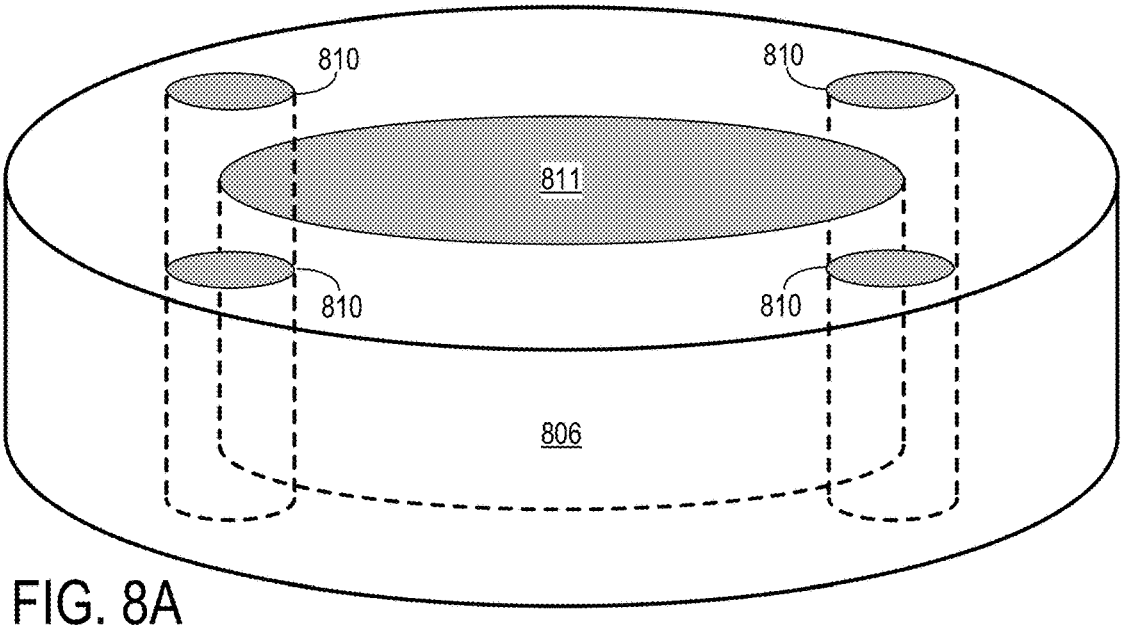
FIGS. 8A and 8B are partial front and top views including selected elements of an embodiment of a movable target holder including a cylindrical body.
Figure 8B:
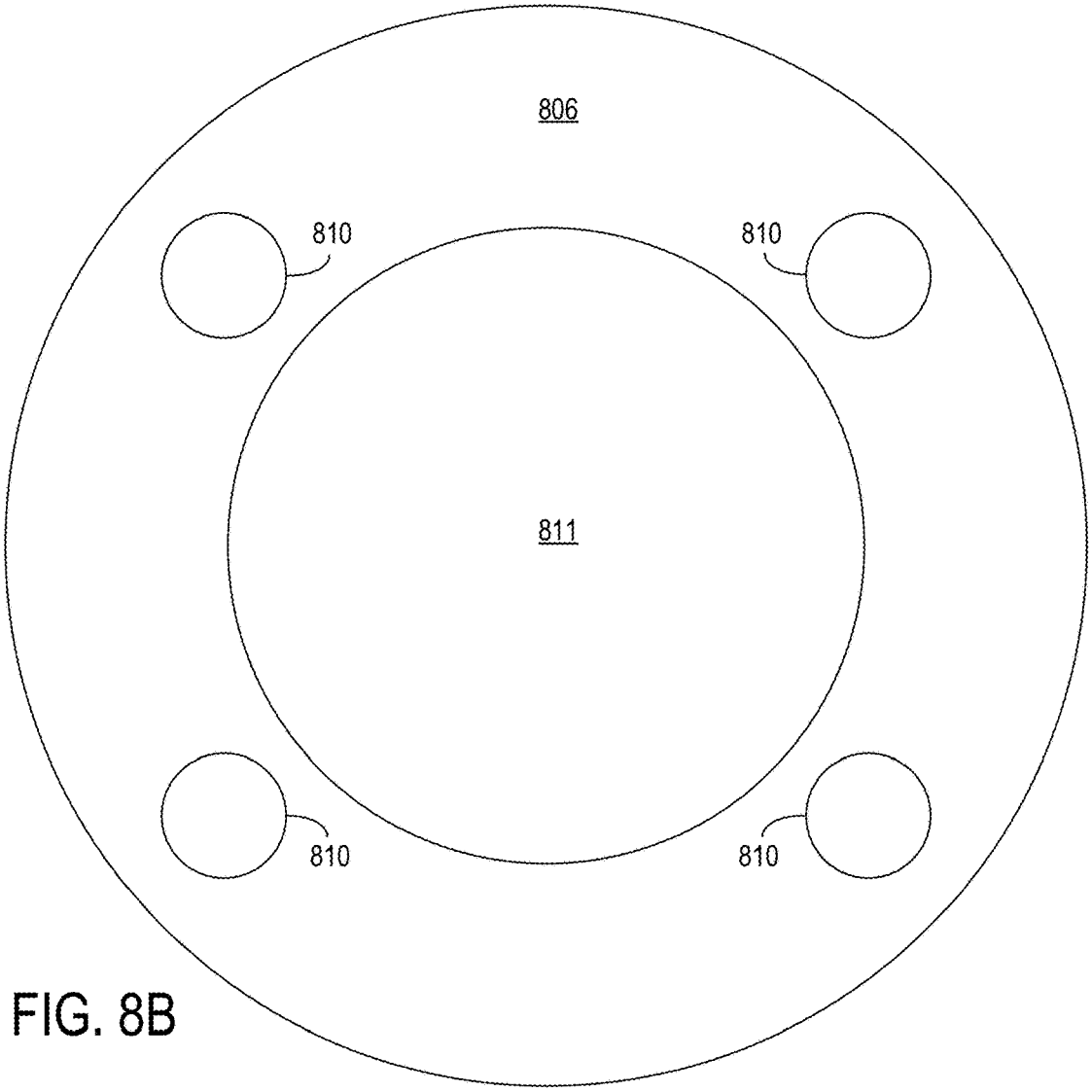

FIGS. 8A and 8B are partial front and top views including selected elements of an embodiment of a movable target holder 806 having a cylindrical body. Target holder 806 may include a plurality of cylindrical holes 810 in an inner portion of target holder 806 and a cylindrical hole 811 in the inner portion of target holder 806. Cylindrical hole 811 may have a center proximate the center of the cylindrical body of target holder 806 and a diameter less than the diameter of the cylindrical body of target holder 806. Cylindrical holes 810 may be proximate the diameter of cylindrical hole 811 plus a margin to maintain the structural strength of target holder 806. Cylindrical holes 810 may have a rounded, chamfered, or beveled opening on the bottom side of target holder 806. Each suspension line 104 may pass through a respective cylindrical hole 810. The rounded, chamfered, or beveled opening of each cylindrical hole 810 on the bottom side of target holder 806 may prevent target holder 806 from a possible disruption or binding while target holder 806 slides downward along each suspension line 104 passing through a respective cylindrical hole 810 of target holder 806. Cylindrical hole 811 may have rounded, chamfered, or beveled openings on both the top side and the bottom side of target holder 806, which may prevent a destructible target 120 from being destroyed when the destructible target 120 contacts target holder 806. FIGS. 8A and 8B show the dimensions of target holder 806, cylindrical holes 810, and cylindrical hole 811.

In some embodiments, a target holder 806 may have a height between 0.75" to 2", an outside diameter between 3" and 9", an inner diameter of cylindrical hole 811 between 3.75" and 8.25", and an inner diameter of cylindrical holes 810 between 0.75" and 1.5". In one particular embodiment, such a target holder may have a height of 1", an outside diameter of 6", an inner diameter of cylindrical hole 811 of 5", and an inner diameter of cylindrical holes 810 of 1". In one or more other embodiments, the height, the outside diameter, the inner diameter of cylindrical hole 811, and the inner diameter of cylindrical holes 810 of target holders 106 may have different dimensions based on the type of material utilized, dimensions of destructible targets 120, number of target holders, dimensions of suspension lines 104, among other factors.

Figure 9A:
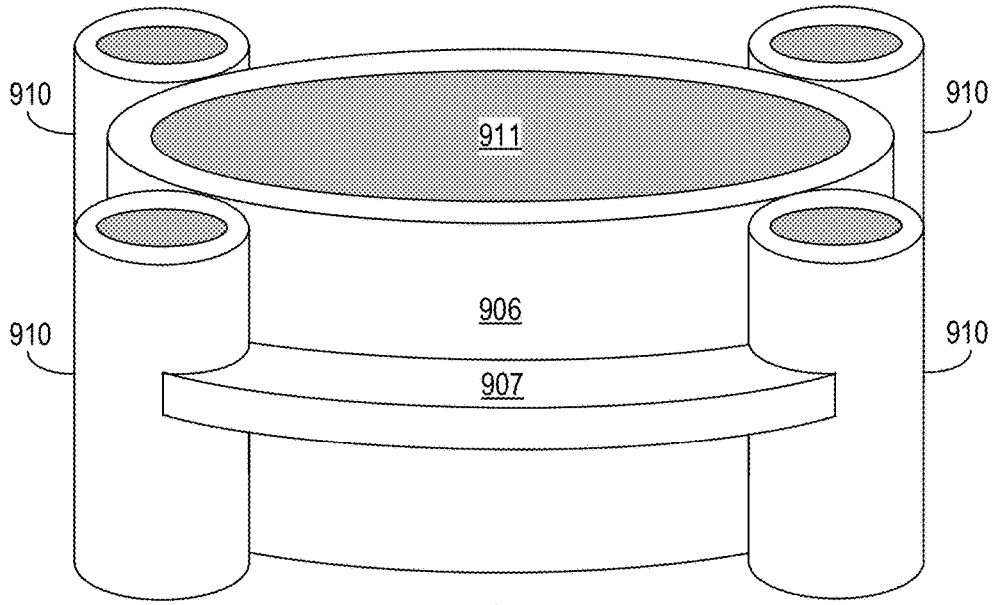
FIGS. 9A and 9B are partial front and top views including selected elements of an embodiment of a movable target holder including a cylindrical body including flanges.
Figure 9B:
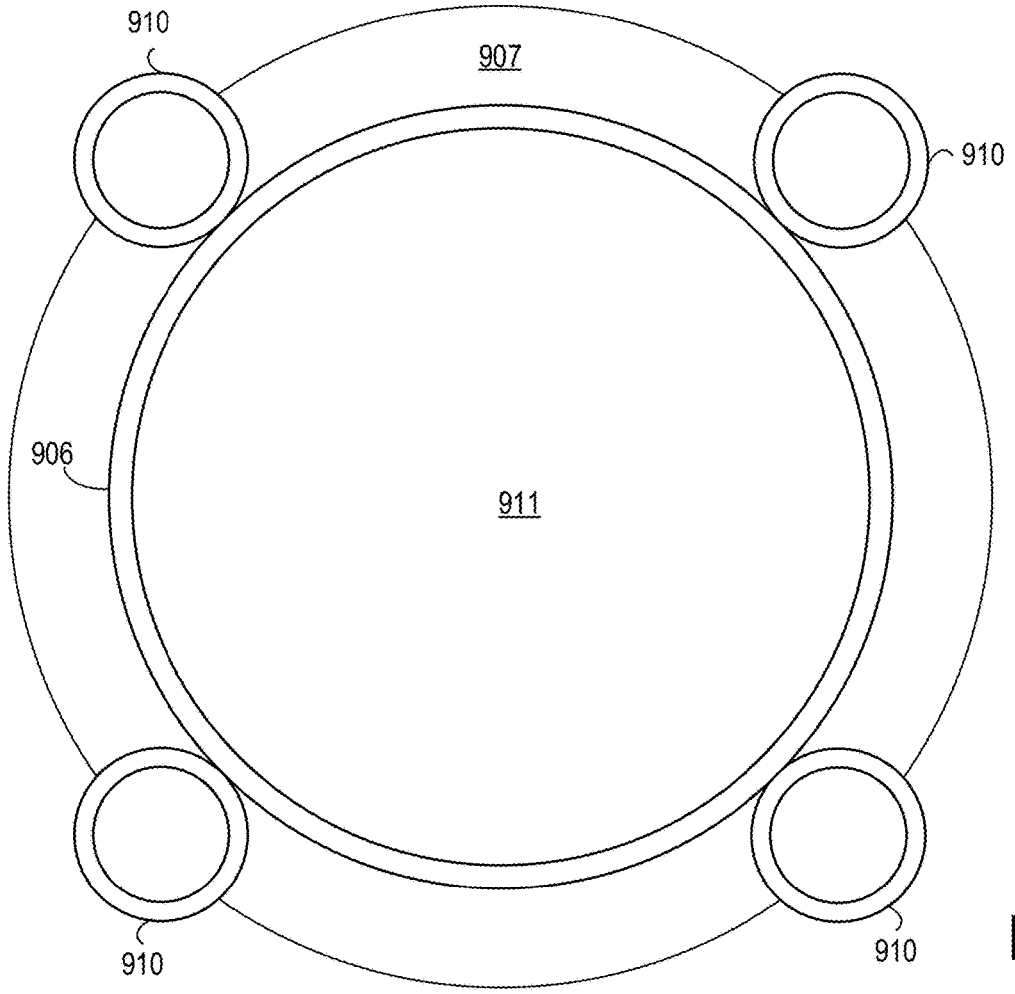

FIGS. 9A and 9B are partial front and top views including selected elements of an embodiment of a movable target holder 906 including a cylindrical body, a cylindrical hole 911, a plurality of cylindrical rings 910, and a plurality of flanges 907. Each cylindrical ring 910 may be coupled to an outer side of target holder 906. Each flange 907 of the plurality of flanges 907 may be coupled between two respective cylindrical rings 910, which may improve the structural strength of target holder 906. Each cylindrical ring 910 may have a rounded, chamfered, or beveled bottom edge. Each suspension line 104 may pass through a respective cylindrical ring 910. The rounded, chamfered, or beveled bottom edge of each cylindrical ring 910 may prevent target holder 906 from a possible disruption or binding while target holder 906 slides downward along each suspension line 104 passing through a respective cylindrical ring 910. Cylindrical hole 911 may have both a rounded, chamfered, or beveled top edge and a rounded, chamfered, or beveled bottom edge, which may prevent a destructible target 120 from being destroyed when the destructible target 120 contacts target holder 906.

In some embodiments, a target holder 906 may have a height between 0.75" to 2", an outside diameter between 3" and 9", an inner diameter of cylindrical hole 911 between 2.75" and 8.75", a thickness of between on the order of 0.133" to 0.375", a width of flanges 907 between 0.75" and 1.5", and a thickness of flanges 907 of between on the order of 0.133" to 0.375". In one particular embodiment, target holder 906 may have a height of 1.5", an outside diameter of 4.83", an inner diameter of cylindrical hole 911 of 3.068", a thickness of between on the order of 0.133" to 0.375", a width of flanges 907 of between on the order of 0.625" and 1.33", and a thickness of flanges 907 of between on the order of 0.133" to 0.375". In some embodiments, a cylindrical ring 910 may have a height between 0.75" to 2", an inside diameter between 0.75" and 1.5", an outside diameter between 1" and 2", and a thickness of between on the order of 0.133" to 0.375". In one particular embodiment, a cylindrical ring 910 may have a height of 1.5", an inside diameter of 1.049", an outside diameter of 1.35", and a thickness of 0.301". In one or more other embodiments, the height, the outside diameter, the inner diameter of cylindrical hole 911, the thickness of a target holder 906, the width of flanges 907, the thickness of flanges 907, and the height, inside and outside diameters, and thickness of a cylindrical ring 910 may have different dimensions based on the type of material utilized, dimensions of destructible targets 120, number of target holders 906, dimensions of suspension lines 104, among other factors.

Figure 10A:
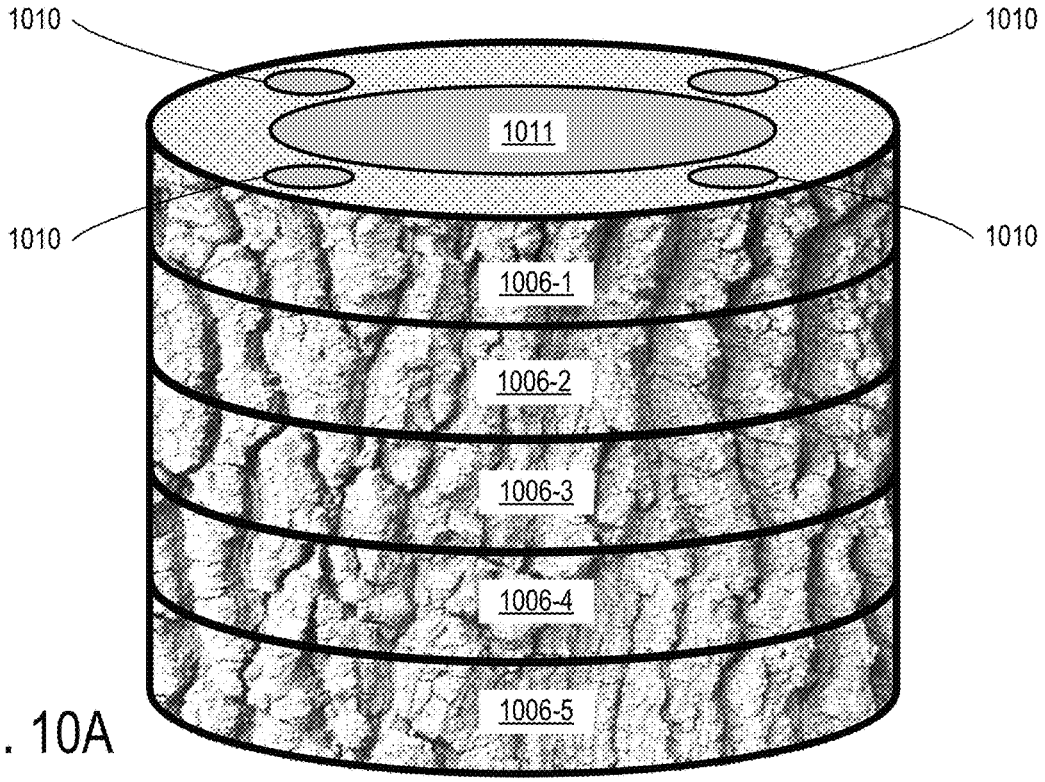
FIGS. 10A and 10B are partial front and top views including selected elements of embodiments of movable target holders including a cross-sectional portion of a tree trunk.
Figure 10B:
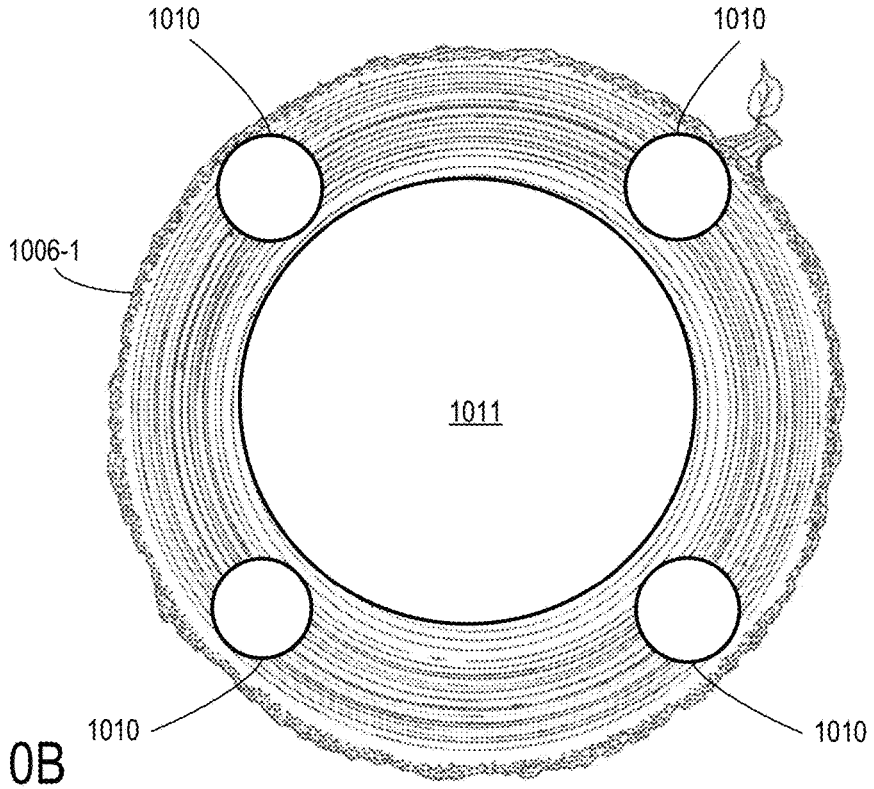

FIGS. 10A and 10B illustrate various views including selected elements of an embodiment of a movable target holder 1006 including a cross-section of either a natural tree trunk or a sculptural representation of a tree trunk. FIG. 10A is a three dimensional front view of target holders 1006 including target holders 1006-1, 1006-2, 1006-3, 1006-4, and 1006-5. As shown, each target holder 1006 of the plurality of target holders 1006 may have a cylindrical body. Each target holder 1006 may include a cylindrical hole 1011 in an inner portion of each target holder 1006, a plurality of cylindrical holes 1010 in the inner portion of target holder 1006, and a cross-sectional portion of the tree trunk. Cylindrical hole 1011 may have a center proximate the center of the cylindrical body of target holder 1006 and a diameter less than the diameter of the cylindrical body of target holder 1006. Cylindrical holes 1010 may be proximate the diameter of cylindrical hole 1011 plus a margin to maintain the structural strength of target holder 1006. Each cylindrical hole 1010 may have a rounded, chamfered, or beveled opening on the bottom side of target holder 1006. Each suspension line 104 may pass through a respective cylindrical hole 1010. The rounded, chamfered, or beveled opening of each cylindrical hole 1010 on the bottom side of target holder 1006 may prevent target holder 1006 from a possible disruption or binding while target holder 1006 slides downward along each suspension line 104 passing through a respective cylindrical hole 1010 of target holder 1006. Cylindrical hole 1011 may have rounded, chamfered, painted, coated, and/or beveled openings on both the top side and the bottom side of target holder 1006, which may prevent a destructible target 120 from being destroyed when the destructible target 120 contacts target holder 1006. Each target holder 1006 may include a cross-sectional portion of the tree trunk and when juxtaposed the plurality of target holders 1006 may include the complete cross-section of the tree trunk. In one or more embodiments, an external surface of each target holder 1006 may include a cross-sectional portion of a synthetic tree trunk surface and when juxtaposed the external surfaces of the plurality of target holders 1006 may include the complete synthetic tree trunk surface. FIG. 10B shows a top view of target holder 1006-1 including cylindrical hole 1011, and cylindrical holes 1010.

Figure 11A:
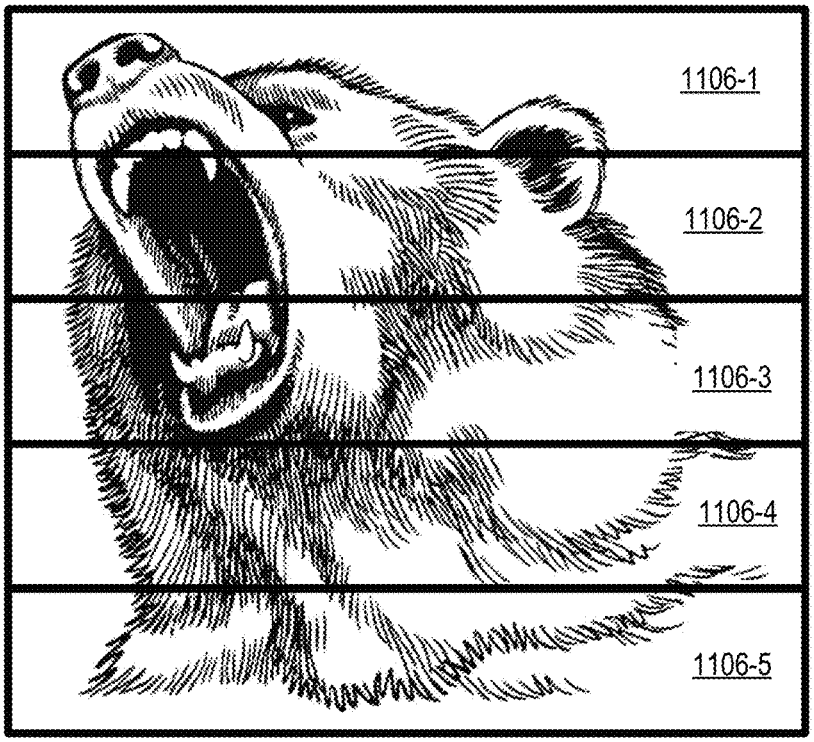
FIGS. 11A and 11B are partial front and top views including selected elements of an embodiment of movable target holders having a semi-circular body with a flat frontal surface.
Figure 11B:
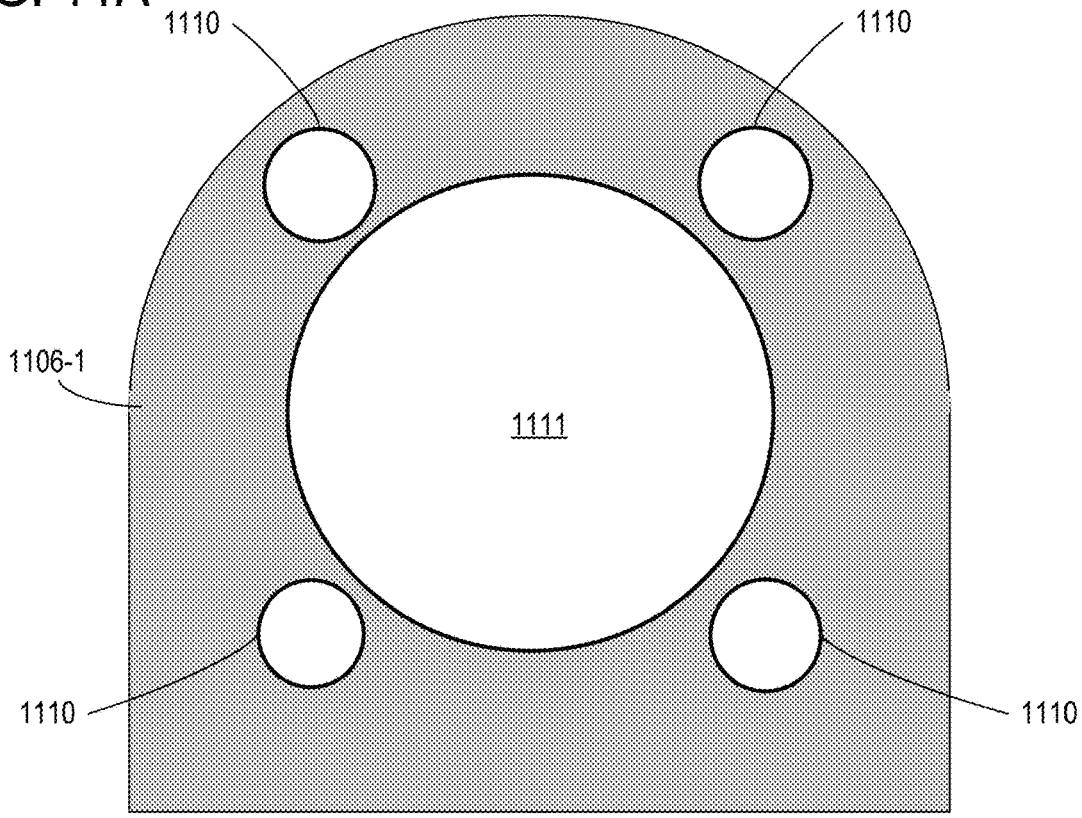

FIGS. 11A and 11B illustrate various views including selected elements of an embodiment of a movable target holder 1106 having a semi-circular body with a flat frontal surface. FIG. 11A is a front view of target holders 1106 including target holders 1106-1, 1106-2, 1106-3, 1106-4, and 1106-5. The flat frontal surface of each target holder 1106 may include a portion of an image and when juxtaposed the plurality of the flat frontal surfaces of the plurality of target holders 1106 may include the complete image. In FIG. 11A, the complete image is of a grizzly bear. In other embodiments, the complete image may be of a deer, a bird, a wild pig, a clown, or another type of image.

FIG. 11B shows a top view of target holder 1106 including cylindrical hole 1111 and cylindrical holes 1110. As shown, each target holder 1106 of the plurality of target holders 1106 may have a semi-circular body with a flat frontal surface. Each target holder 1106 may include a cylindrical hole 1111 in an inner portion of each target holder 1106, and a plurality of cylindrical holes 1110 in the inner portion of target holder 1106. Cylindrical hole 1111 may have a center proximate the center of the semi-circular body of target holder 1106 and a diameter less than the diameter of the semi-circular body of target holder 1106. Cylindrical holes 1110 may be proximate the diameter of cylindrical hole 1111 plus a margin to maintain the structural strength of target holder 1106. Each cylindrical hole 1110 may have a rounded, chamfered, or beveled opening on the bottom side of target holder 1106. Each suspension line 104 may pass through a respective cylindrical hole 1110. The rounded, chamfered, or beveled opening of each cylindrical hole 1110 on the bottom side of target holder 1106 may prevent target holder 1106 from a possible disruption or binding while target holder 1106 slides downward along each suspension line 104 passing through a respective cylindrical hole 1110 of target holder 1106. Cylindrical hole 1111 may have rounded, chamfered, or beveled openings on both the top side and the bottom side of target holder 1106, which may prevent a destructible target 120 from being destroyed when the destructible target 120 contacts target holder 1106.

Figure 12A:
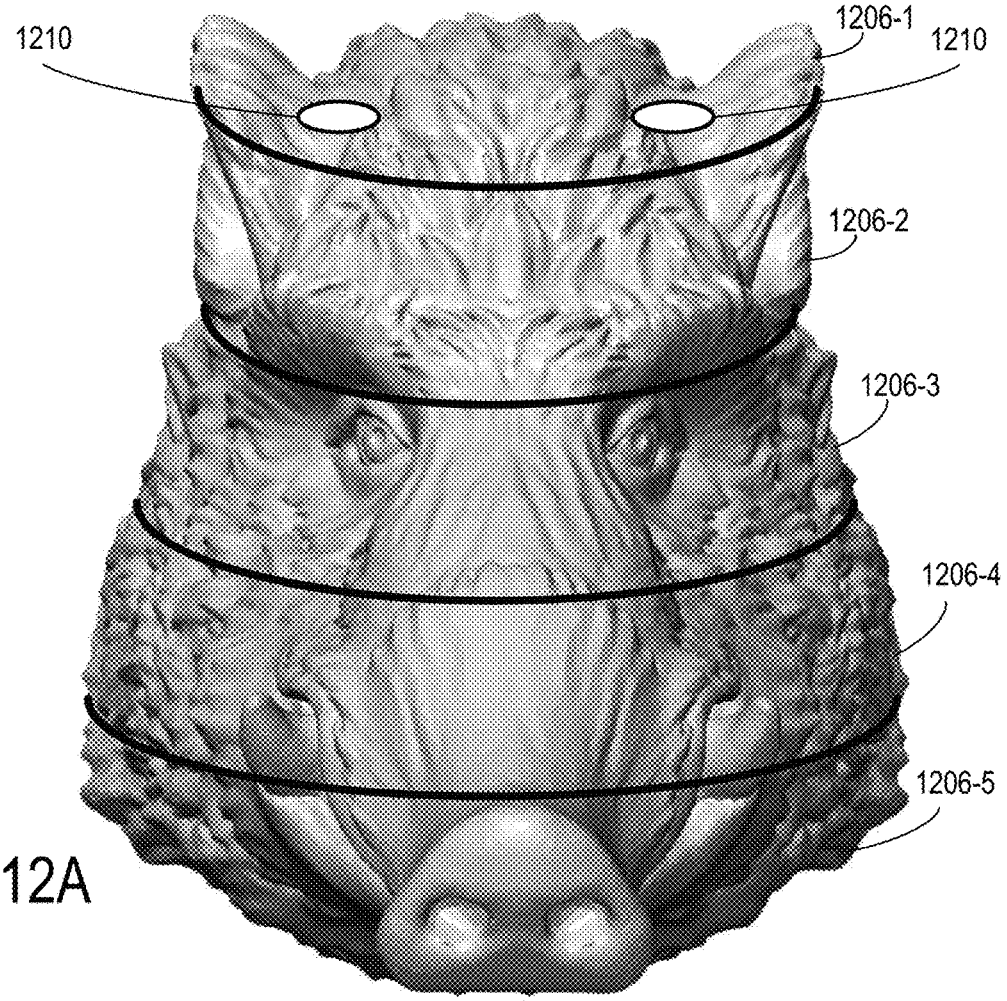
FIGS. 12A and 12B are partial front and top views including selected elements of an embodiment of movable target holders having a three dimensional sculpture.
Figure 12B:
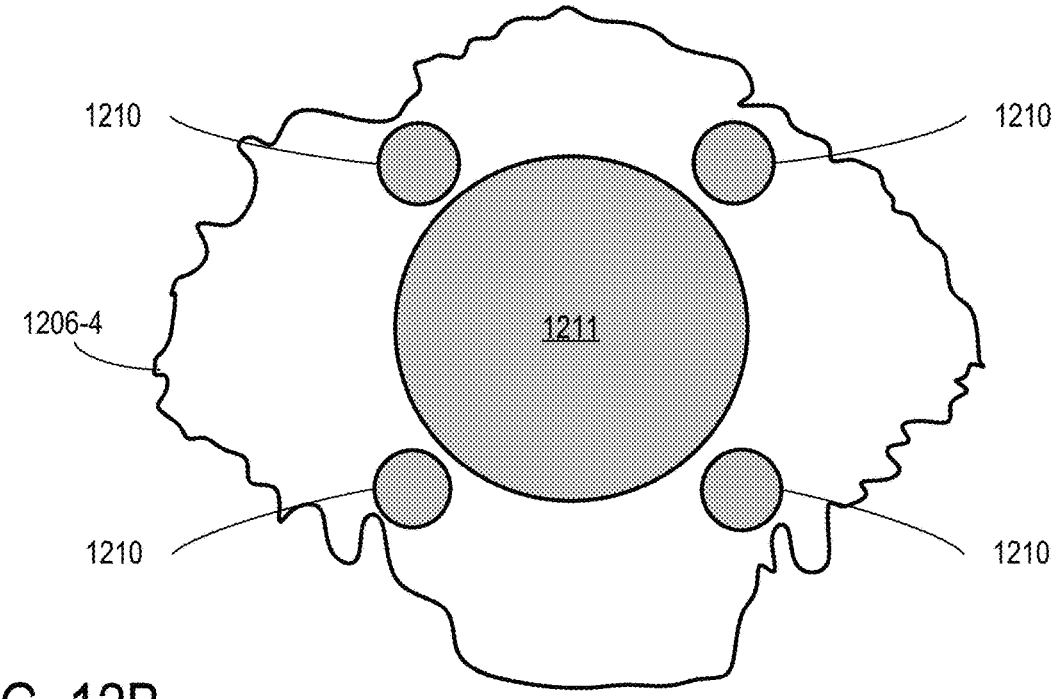

FIGS. 12A and 12B illustrate various views including selected elements of an embodiment of movable target holders 1206 having a three dimensional sculpture. FIG. 12A is a three dimensional front view of target holders 1206 including target holders 1206-1, 1206-2, 1206-3, 1206-4, and 1206-5. As shown in FIG. 12A, each target holder 1206 of the plurality of target holders 1206 may have a cross-sectional portion of a three dimensional sculpture. Each target holder 1206 may include a cylindrical hole 1211 in a center portion of each target holder 1206, and a plurality of cylindrical holes 1210 in an inner portion outside the center portion of target holder 1206. Cylindrical holes 1210 and cylindrical hole 1211 may have a margin of distance between each other that may maintain the structural strength of a target holder 1206. Each cylindrical hole 1210 may have a rounded, chamfered, or beveled opening on the bottom side of target holder 1206. Each suspension line 104 may pass through a respective cylindrical hole 1210. The rounded, chamfered, or beveled opening of each cylindrical hole 1210 on the bottom side of target holder 1206 may prevent target holder 1206 from a possible disruption or binding while target holder 1206 slides downward along each suspension line 104 passing through a respective cylindrical hole 1210 of target holder 1206. Cylindrical hole 1211 may have rounded, chamfered, or beveled openings on both the top side and the bottom side of target holder 1206, which may prevent a destructible target 120 from being destroyed when the destructible target 120 contacts target holder 1206. Each target holder 1206 may include a cross-sectional portion of the three dimensional sculpture and when juxtaposed the plurality of target holders 1206 may include the complete sculpture. In FIG. 12A, the complete sculpture is of a wild boar. In other embodiments, the complete sculpture may be of a deer, a bird, a clown, or another type of sculpture. FIG. 12B shows a top view of target holder 1206 including cylindrical hole 1211 and cylindrical holes 1210.

Figure 13B:
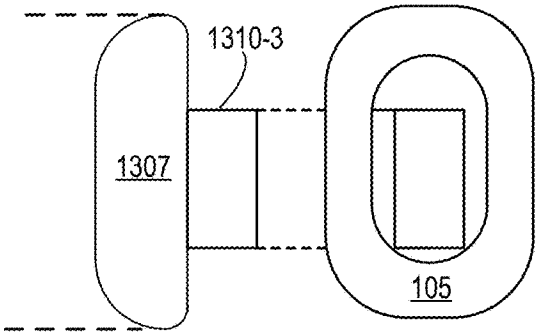
FIGS. 13A, 13B, and 13C are various views including selected elements of embodiments of bottom brackets.
Figure 13A:
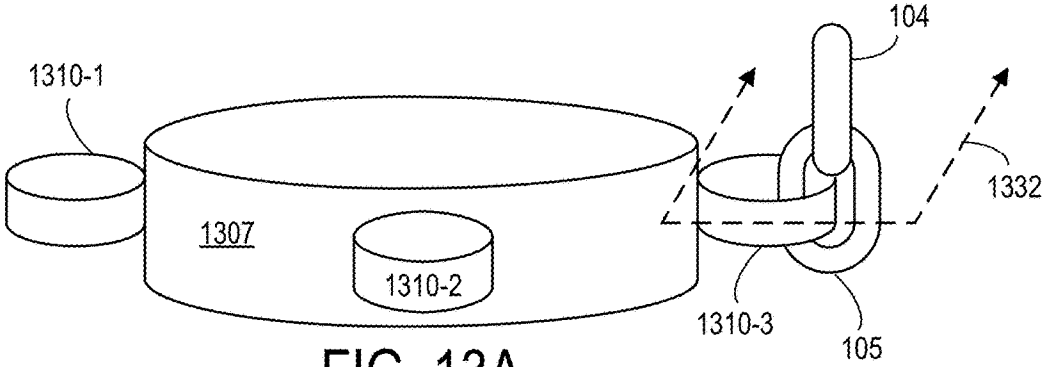
Figure 13C:
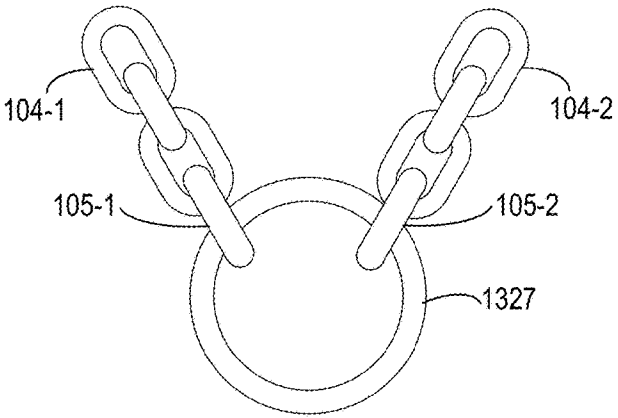

FIGS. 13A, 13B, and 13C illustrate various views including selected elements of an embodiment of a bottom target holder and a bottom target bracket. The various views may include one or more components similar to that of hanging target 100 as described above with reference to FIG. 1A.

FIG. 13A shows a three-dimensional front view of a bottom target holder 1307 coupled to a plurality of cylindrical rings 1310 including cylindrical rings 1310-1, 1310-2, and 1310-3, an end portion 105 of a portion of suspension line 104 coupled to cylindrical ring 1310-3, which is depicted as a chain, and a cut line 1332 of a portion of bottom target holder 1307 and cylindrical ring 1310-3. As shown, the end portion 105 is coupled to cylindrical ring 1310-3 by cylindrical ring 1310-3 passing through the end portion 105.

FIG. 13B illustrates a front view at cut-line 1332 of bottom target holder 1307, cylindrical ring 1310-3, and the end portion 105 coupled to cylindrical ring 1310-3. As shown, the end portion 105 has an upward generally vertical orientation. In FIG. 13B, bottom target holder 1307 has a rounded, chamfered, or beveled top edge. The rounded, chamfered, painted, coated, and/or beveled top edge of bottom target holder 1307 may prevent a destructible target 120 from being destroyed when the destructible target 120 contacts bottom target holder 1307, such as, for example, when destructible target 120 is placed on bottom target holder 1307.

FIG. 13C illustrates a front view of a bottom ring 1327. As shown, an end portion 105-1 of a portion of suspension line 104-1 and an end portion 105-2 of a portion of suspension line 104-2 are coupled to the bottom ring 1327 in an upward generally angled orientation. Bottom ring 1327 may be utilized by hanging targets 100 and 400.

Figure 14:
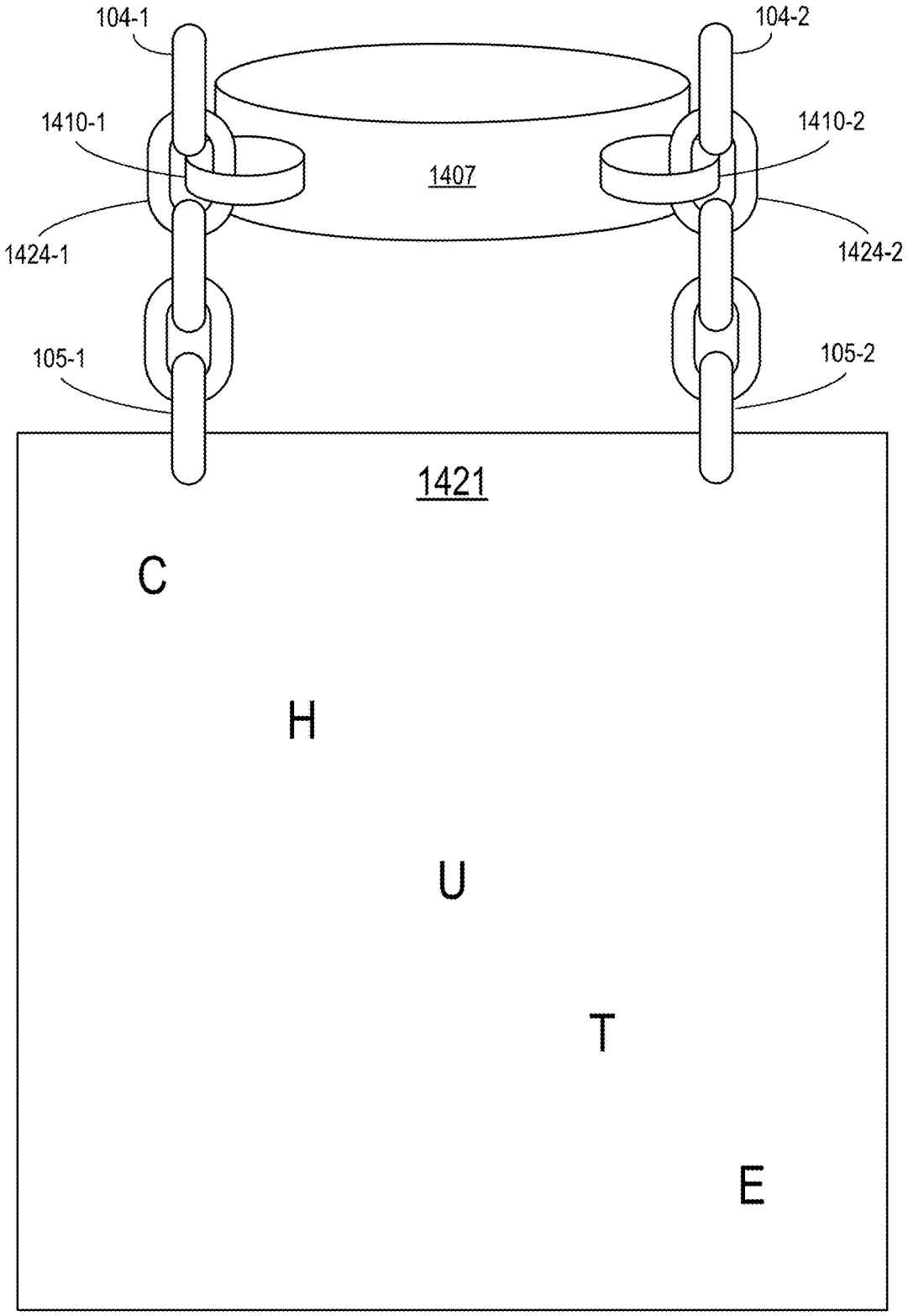
FIG. 14 is a front view including selected elements of embodiments of a bottom bracket having a suspended target.

FIG. 14 is a front view including selected elements of an embodiment of a bottom target holder 1407 having a suspended target 1421. The front view may include one or more components similar to that of hanging target 100 as described above with reference to FIG. 1A.

FIG. 14 shows a bottom target holder 1407 coupled to a plurality of cylindrical rings 1410 including cylindrical rings 1410-1 and 1410-2. As shown, a mid-portion 1424-1 of a portion of suspension line 104-1 is coupled to cylindrical ring 1410-1, which is depicted as a chain, and a mid-portion 1424-2 of a portion of suspension line 104-2 is coupled to cylindrical ring 1410-2. An end portion 105-1 of a portion of suspension line 104-1 is coupled to a suspended target 1421 proximate a top edge and a first side edge of suspended target 1421 and an end portion 105-2 of a portion of suspension line 104-2 is coupled to suspended target 1421 proximate the top edge and a second side edge opposite the first side edge of suspended target 1421. Suspended target

1421 proximate a bottom edge of bottom target holder 1407 such that suspended target 1421 hangs below bottom target holder 1407.

In some embodiments, a suspended target 1421 may have a rectangular shape with a length between 4" and 6" and a height between 4" and 6". In one particular embodiment, a suspended target 1421 may have a length and a height of 5". In one or more other embodiments, suspended target 1421 may have a different shape such as a sphere, a block, a circle shape, an oval shape, a triangle shape, or another type of shape, and different dimensions based on the type of material utilized, dimensions of the hanging target such as hanging target 100, among other factors. In some embodiments, suspended target 1421 may comprise steel, which may be abrasion resistant (AR) 300 to AR 500 grade steel and have a thickness between ⅜" and ½". In one or more other embodiments, suspended target 1421 may comprise another type of material.

Figure 15:
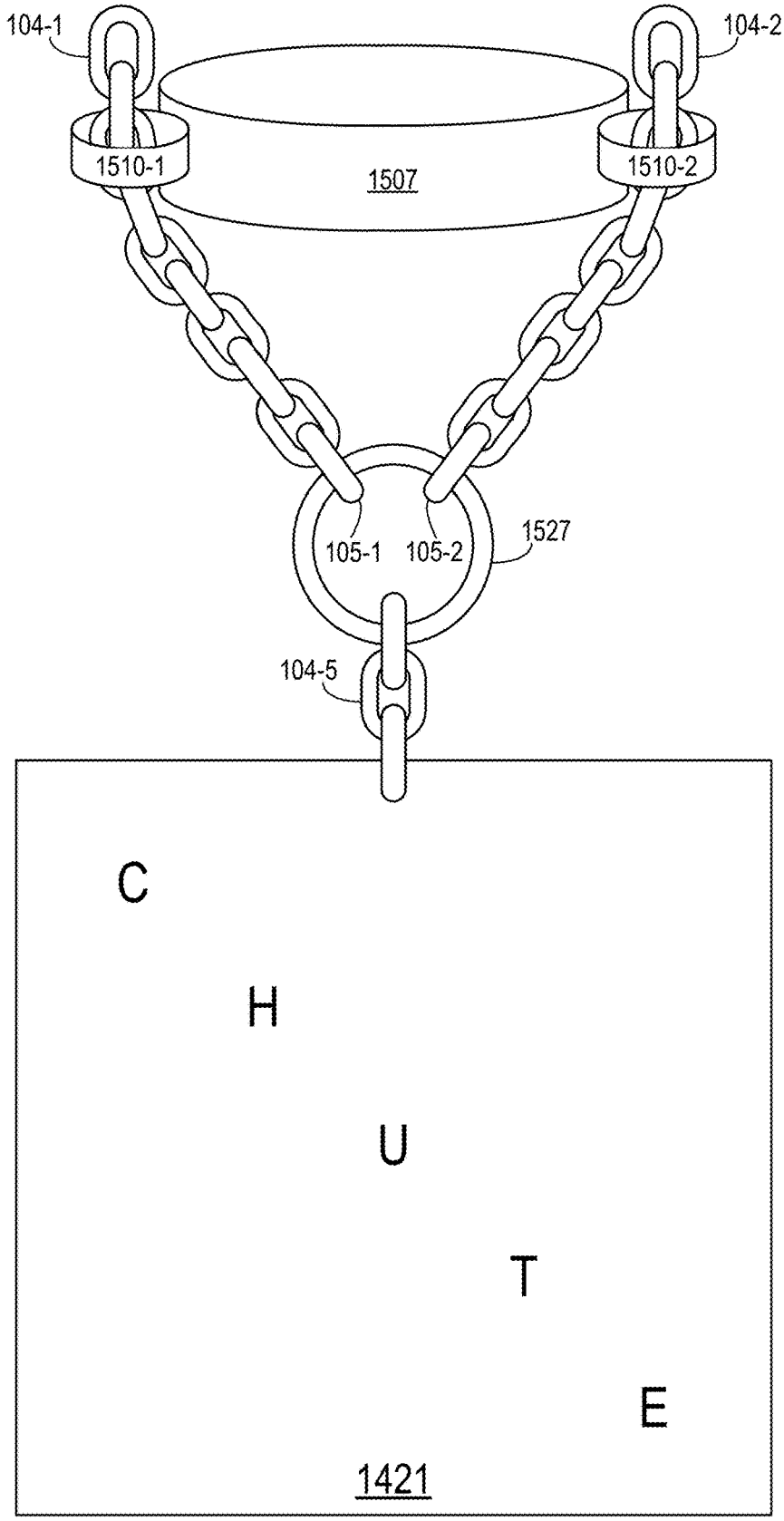
FIG. 15 is a front view including selected elements of embodiments of a bottom bracket having a suspended target.

FIG. 15 is a front view including selected elements of an embodiment of a bottom target holder 1507, a bottom ring 1527, and suspended target 1421. The front view may include one or more components similar to that of hanging target 100 as described above with reference to FIG. 1A.

FIG. 15 shows a bottom target holder 1507 coupled to a plurality of cylindrical rings 1510 including cylindrical rings 1510-1 and 1510-2. Suspension lines 104-1 and 104-2 pass through cylindrical rings 1510-1 and 1510-2, respectively. An end portion 105-1 of a portion of suspension line 104-1 and an end portion 105-2 of a portion of suspension line 104-2 are coupled to the bottom ring 1527 in an upward generally angled orientation. Suspended target 1421 is coupled to bottom ring 1327 by a suspension line 104-5 proximate a center portion of a top edge of suspended target 1421. Suspended target 1421 proximate a bottom edge of bottom target holder 1507 such that suspended target 1421 hangs below bottom target holder 1507. As shown, suspension line 104-5 is depicted as a chain. In some embodiments, suspension line 104-5 may be a different type of suspension line and may be coupled to suspended target 1421 by a swivel coupling such that suspended target 1421 spins when hit by a projectile.

Figure 16A:
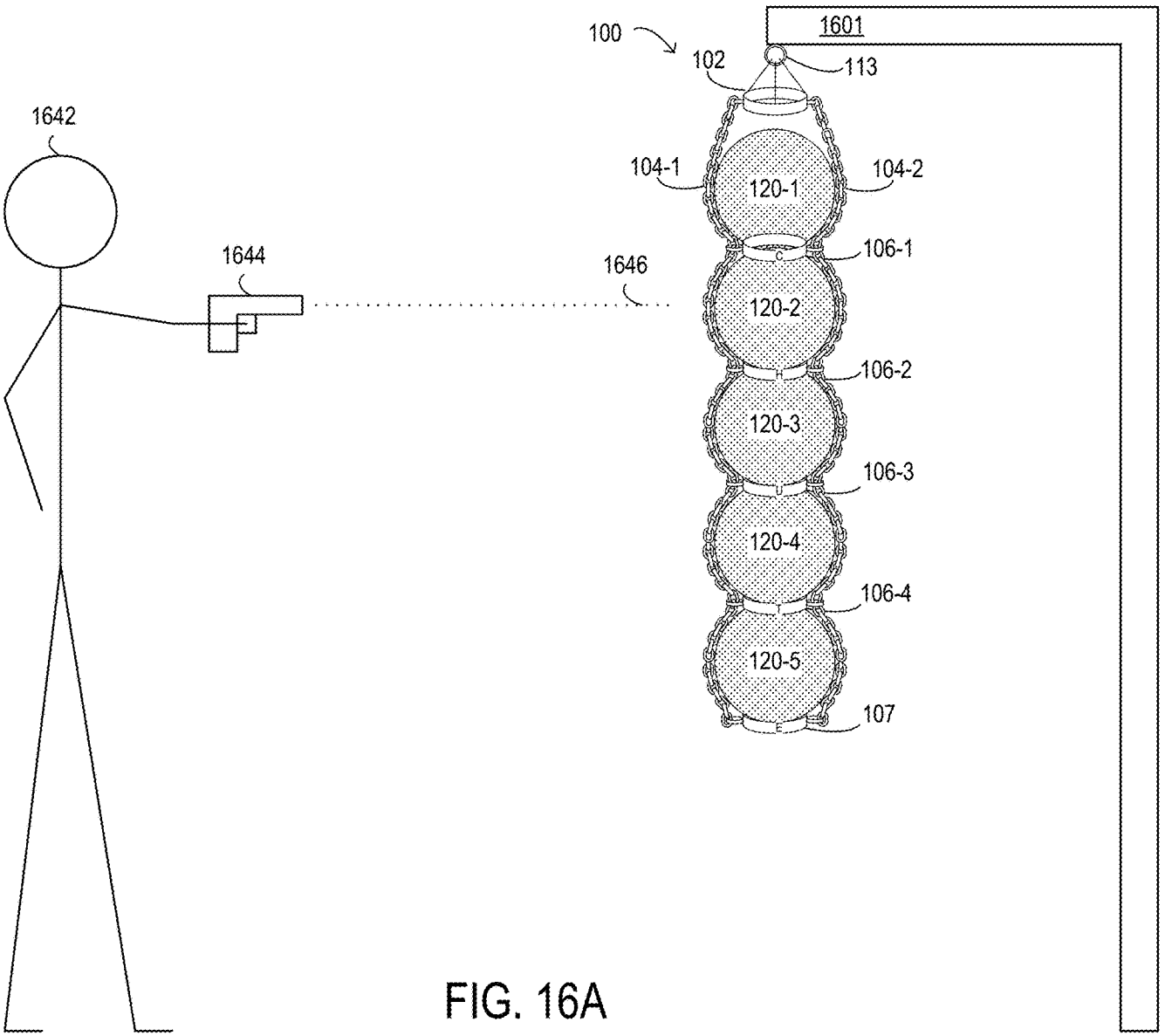
FIGS. 16A and 16B are side views including a shooter and selected elements of embodiments of hanging targets with movable target holders.

FIGS. 16A and 16D illustrate side views including a shooter 1642 and selected elements of embodiments of hanging targets with movable target holders and a bottom target holder. The side views may include one or more components similar to that of hanging target 100 as described above with reference to FIG. 1A.

FIG. 16A illustrates a side view including a shooter 1642 and selected elements of an embodiment of hanging target 100 with movable target holders 106 and bottom target holder 107. In FIG. 16A, hanging target 100 is coupled to an overhead post 1601 by hanging bracket 102. Each target holder 106 and bottom target holder 107 is hanging from hanging bracket 102 by suspension lines 104 coupled to hanging bracket 102. Each successive target holder 106 and bottom target holder 107 may hang beneath a target holder 106 immediately above the successive target holder 106, with the exception of a top target holder 106. As shown, target holder 106-2 hangs beneath target holder 106-1, target holder 106-3 hangs beneath target holder 106-2, target holder 106-4 hangs beneath target holder 106-3, and bottom target holder 107 hangs beneath target holder 106-4. Hanging target 100 is in the fully-loaded position, where destructible target 120-1 is disposed at target holder 106-1, destructible target 120-2 is disposed at target holder 106-2, destructible target 120-3 is disposed at target holder 106-3, destructible target 120-4 is disposed at target holder 106-4, and destructible target 120-5 is disposed at bottom target holder 107. In FIG. 16A, shooter 1642 is holding a hand gun 1644 and shooting a projectile 1646 at destructible target 120-2.

Figure 16B:
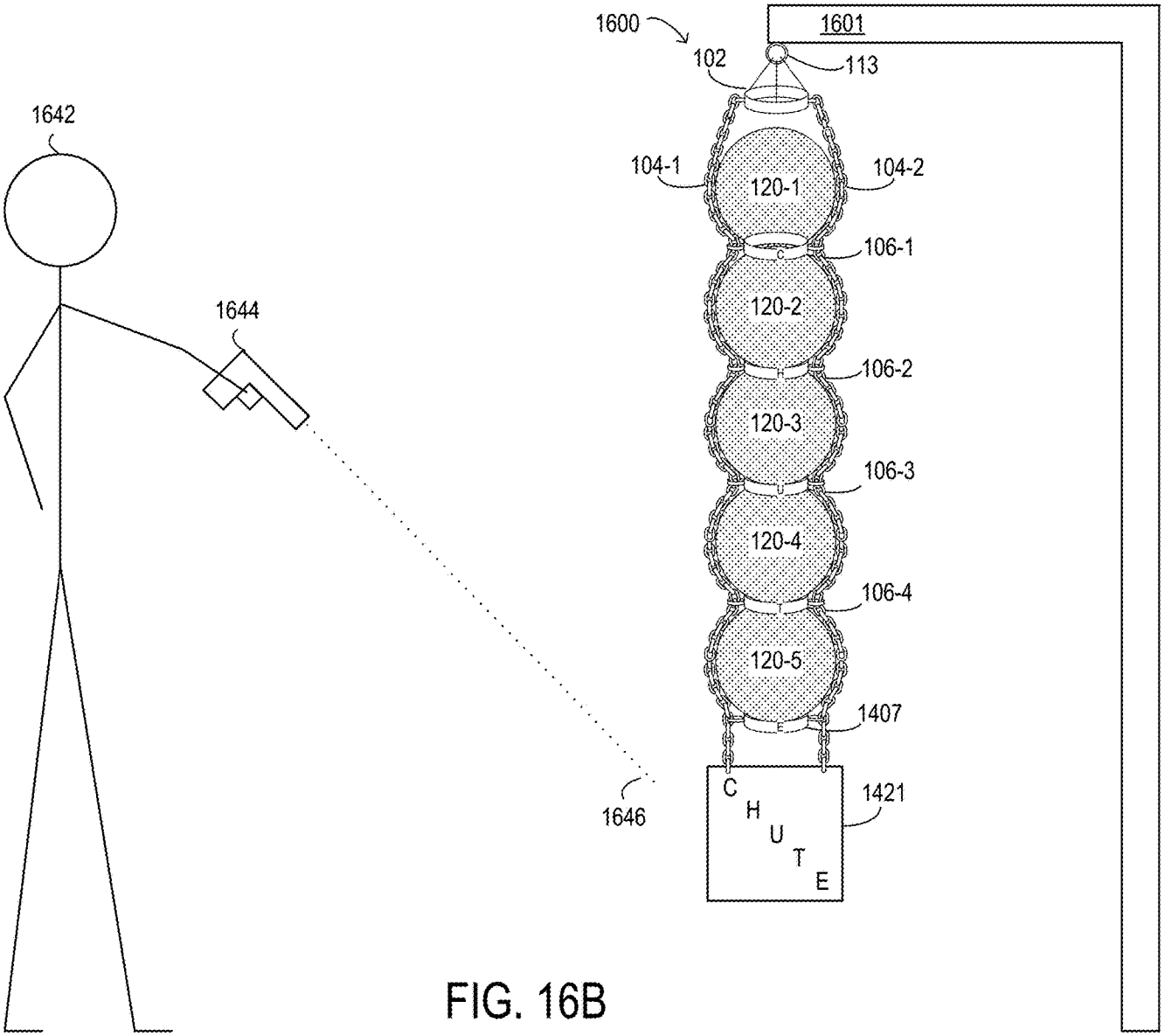

FIG. 16B illustrates a side view including a shooter 1642 and selected elements of an embodiment of a hanging target 1600 with movable target holders 106, a bottom target holder 1407, and suspended target 1421. In FIG. 16B, hanging target 1600 is coupled to an overhead post 1601 by hanging bracket 102. Each target holder 106 and bottom target holder 1407 is hanging from hanging bracket 102 by suspension lines 104 coupled to hanging bracket 102. Each successive target holder 106 and bottom target holder 1407 may hang beneath a target holder 106 immediately above the successive target holder 106, with the exception of a top target holder 106. As shown, target holder 106-2 hangs beneath target holder 106-1, target holder 106-3 hangs beneath target holder 106-2, target holder 106-4 hangs beneath target holder 106-3, and bottom target holder 1407 hangs beneath target holder 106-4. Suspended target 1421 is coupled to bottom target holder 1407 and hangs beneath bottom target holder 1407. Hanging target 1600 is in the fully-loaded position, where destructible target 120-1 is disposed at target holder 106-1, destructible target 120-2 is disposed at target holder 106-2, destructible target 120-3 is disposed at target holder 106-3, destructible target 120-4 is disposed at target holder 106-4, and destructible target 120-5 is disposed at bottom target holder 1407. In FIG. 16B, shooter 1642 is holding hand gun 1644 and shooting projectile 1646 at suspended target 1421.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A hanging target, comprising:

a hanging bracket;

a first and a second suspension line coupled to the hanging bracket, the first and the second suspension lines generally parallel with each other in a generally vertical orientation; and a plurality of target holders including a first target holder and a second target holder, each target holder simultaneously coupled to each of the first and the second suspension lines such that the first target holder is positioned at a first position of the first and the second suspension lines and the second target holder is positioned at a second position of the first and the second suspension lines lower than the first position, the target holders configured and placed relative to one another to change a positioning of respective portions of each suspension line of the plurality of suspension lines with respect to one another, including such that when a destructible target is disposed above and carried by the second target holder, the respective portion of each suspension line of the plurality of suspension lines extends outward around the destructible target and such that when the destructible target is destroyed by a projectile that hits the destructible target, the respective portion of each suspension line rebounds to the generally vertical orientation, wherein when the destructible target is destroyed, the first target holder is configured to slide downward to abut the second target holder.

2. The hanging target of claim 1, wherein each target holder further comprises a plurality of cylindrical rings coupled to an outer surface of the target holder and each of the first and the second suspension lines passes through a respective cylindrical ring of each target holder.

3. The hanging target of claim 2, wherein each cylindrical ring of the plurality of cylindrical rings has a rounded, chamfered, or beveled bottom edge to reduce disruptions while a respective target holder slides downward along the first and the second suspension lines.

4. The hanging target of claim 1, wherein each of the first and the second suspension lines pass through each target holder.

5. The hanging target of claim 1, wherein each target holder further comprises a plurality of cylindrical holes in an inner portion of the target holder and each of the first and the second suspension lines pass through a respective cylindrical hole of each target holder.

6. The hanging target of claim 1, wherein each target holder further comprises a plurality of cylindrical rings coupled to an outer side of the target holder and a plurality of flanges, each flange of the plurality of flanges coupled to two respective cylindrical rings of the plurality of cylindrical rings, and each of the first and the second suspension lines pass through a respective cylindrical ring of each target holder.

7. The hanging target of claim 1, wherein each target holder is coupled to the first and the second suspension lines at a respective fixed position of each of the first and the second suspension lines.

8. The hanging target of claim 1, wherein each target holder has a rounded, chamfered, painted, coated, or beveled top edge to prevent the destructible target from being destroyed when the destructible target contacts a respective target holder.

9. The hanging target of claim 1, wherein each target holder comprises material that is selected to reduce ricochets including a polymer sheet, a formed polymer, a polymorphic polymer, rubber, plastic, wood, a cross-sectional portion of a tree trunk, metal, steel, stainless steel, steel alloy, iron, or combinations thereof.

10. The hanging target of claim 1, wherein each target holder has an external surface that comprises a portion of an image and when juxtaposed the external surfaces of the plurality of the target holders comprise the complete image.

11. The hanging target of claim 1, wherein each target holder comprises a cross-sectional portion of a sculpture and when juxtaposed the plurality of the target holders comprise the complete sculpture.

12. The hanging target of claim 1, wherein each of the first and the second suspension lines comprises a chain, a cable, a coated cable, a rope, a plastic line, a string, a polymeric strand or strip, or a ribbon.

13. The hanging target of claim 1, wherein the projectile comprises a metallic ball, a pellet, a bullet, an arrow, slingshot ammunition, nerf balls, paint balls, air soft pellets, or a dart.

14. The hanging target of claim 1, wherein the destructible target comprises an inflatable device, a water-filled device, a piece of suitably sized and shaped fruit, a balloon, a sponge, or a self-healing device.

15. The hanging target of claim 1, further comprising:

a suspended target coupled to the second target holder below the second target holder, the suspended target operable to swivel such that the suspended target spins when hit by a projectile.

16. The hanging target of claim 1, further comprising:

a suspended target coupled to at least one of the first and the second suspension lines below the second target holder.

17. The hanging target of claim 1, wherein the destructible target comprises a bladder filled with chalk or suitable powder.

18. A method, comprising:

moving a first target holder of a plurality of target holders of a hanging target positioned at a first position of a plurality of suspension lines of the hanging target to a second position of the plurality of suspension lines higher than the first position, wherein the plurality of suspension lines coupled to each target holder and a hanging bracket of the hanging target, and the plurality of suspension lines generally parallel with each other in a generally vertical orientation; and disposing a destructible target at a second target holder of the plurality of target holders between the plurality of suspension lines such that a respective portion of each suspension line of the plurality of suspension lines extends outward around the destructible target and such that when the destructible target is destroyed by a projectile that hits the destructible target, the respective portion of each suspension line rebounds to the generally vertical orientation, wherein the second target holder is positioned at a third position of the plurality of suspension lines lower than the first position and below the first target holder.

19. A hanging target, comprising:

a hanging bracket;

a plurality of suspension lines coupled to the hanging bracket, the plurality of suspension lines generally parallel with each other in a generally vertical orientation; and a plurality of target holders including a first target holder and a second target holder:

each target holder coupled to the plurality of suspension lines such that the first target holder is positioned at a first position of the plurality of suspension lines above the second target holder and the second target holder is positioned at a second position of the plurality of suspension lines, the first target holder operable to slide downward along the plurality of suspension lines in a generally vertical direction, and the second target holder operable to receive destructible targets such that when a first destructible target disposed above and carried by the second target holder is destroyed by a projectile that hits the first destructible target, the first target holder slides downward to abut the second target holder.

* * * * *